US010136741B2

(12) United States Patent
Feldman

(10) Patent No.: US 10,136,741 B2
(45) Date of Patent: Nov. 27, 2018

(54) FRESH FOOD AND DRY GOODS FOODSERVICE MERCHANDISING DISPLAY CASE WITH INTERCHANGEABLE KIT UTILITY SYSTEM

(71) Applicant: Carl Bruce Feldman, Palm Beach Gardens, FL (US)

(72) Inventor: Carl Bruce Feldman, Palm Beach Gardens, FL (US)

( * ) Notice: Subject to any disclaimer, the term of this patent is extended or adjusted under 35 U.S.C. 154(b) by 6 days.

(21) Appl. No.: 15/079,674

(22) Filed: Mar. 24, 2016

(65) Prior Publication Data

US 2016/0286986 A1 Oct. 6, 2016

Related U.S. Application Data

(60) Provisional application No. 62/140,981, filed on Mar. 31, 2015.

(51) Int. Cl.

| | |
|---|---|
| ***A47F 5/12*** | (2006.01) |
| ***A47F 7/00*** | (2006.01) |
| ***A47F 5/16*** | (2006.01) |
| ***A47F 3/04*** | (2006.01) |
| ***A47F 3/14*** | (2006.01) |

(52) U.S. Cl.

CPC ..... *A47F 7/0071* (2013.01); *A47F 3/0439* (2013.01); *A47F 3/14* (2013.01); *A47F 5/12* (2013.01); *A47F 5/16* (2013.01); *A47F 2003/0473* (2013.01); *A47F 2005/165* (2013.01)

(58) Field of Classification Search

CPC .. A47F 3/0439; A47F 3/14; A47F 5/12; A47F 5/16; A47F 2003/0473; A47F 2005/165; A47F 10/06; F25D 3/08; F25D 3/06; F25D 2400/08; A22C 25/06; A22C 17/0013; A47B 37/00

USPC ..... 108/6

See application file for complete search history.

(56) References Cited

U.S. PATENT DOCUMENTS

| | | | | | |
|---|---|---|---|---|---|
| 2,786,337 | A * | 3/1957 | Spring | F25D 23/12 | 232/43.2 |
| 3,730,603 | A * | 5/1973 | Looms | A01G 5/06 | 312/116 |
| 4,189,928 | A * | 2/1980 | Cerny | A22C 17/0013 | 62/261 |
| 4,440,185 | A * | 4/1984 | Wiltse | B26D 7/088 | 134/104.4 |
| 5,312,178 | A * | 5/1994 | King | E05B 67/383 | 269/289 R |
| 5,363,755 | A * | 11/1994 | Liang | A47B 77/02 | 241/273.2 |
| 6,745,588 | B2 * | 6/2004 | Kahler | A47F 3/0486 | 211/169.1 |

(Continued)

*Primary Examiner* — Daniel J Troy
*Assistant Examiner* — Timothy M Ayres

(57) ABSTRACT

A fresh food and dry goods foodservice merchandising display case with interchangeable kit utility system is disclosed. This mobile insulated display table with fully-welded, corrosion-resistant 304 stainless steel construction is built for use in association with interchangeable full-service, self-service and accessory component kits precisely dimensioned to be easily fitted and removed as described herein. The mobile insulated display table serves as the system base, and features a bent tubular steel frame, and adjustable tilting mechanism with three positions, a welded stainless steel drain, a shutoff valve, a 5' insulated drain hose and a hose hanging bracket.

3 Claims, 42 Drawing Sheets

(56) References Cited

U.S. PATENT DOCUMENTS

| | | | | |
|---|---|---|---|---|
| 6,769,752 | B2 * | 8/2004 | Hahn | A47F 3/005 312/114 |
| 9,049,963 | B2 * | 6/2015 | Young | A47J 47/005 |
| 2005/0040580 | A1 * | 2/2005 | Davis | A47J 47/005 269/289 R |

* cited by examiner

MOBILE INSULATED DISPLAY
TABLE – MIT– M

MOBILE INSULATED DISPLAY TABLE – MIT– M
FIG.1G
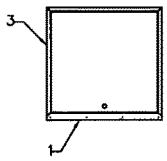
FIG.1H
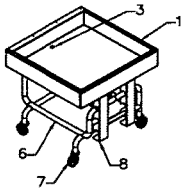
FIG.1I
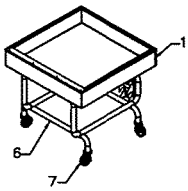
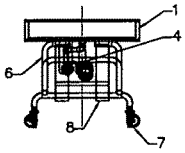
FIG.1J
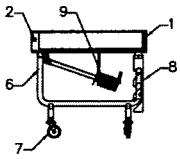
FIG.1K MOBILE INSULATED DISPLAY TABLE – MIT– M
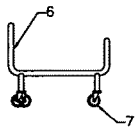
FIG.1M
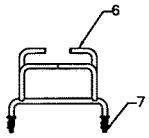
FIG.1N
FIG.1L
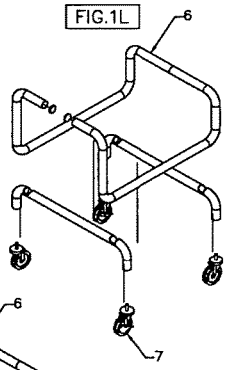
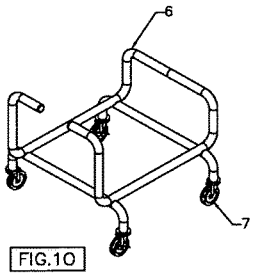
FIG.1O

MOBILE INSULATED DISPLAY TABLE – MIT– M

MOBILE INSULATED DISPLAY TABLE – MIT– M
FIG.1R
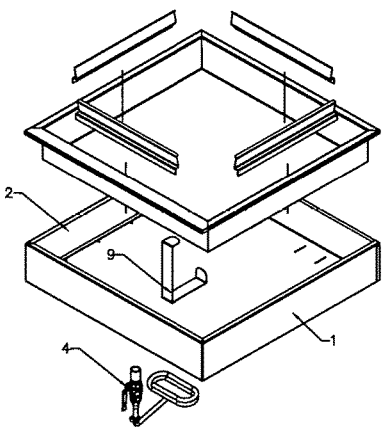
FIG.1S
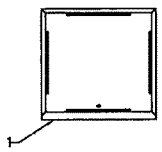
FIG.1T
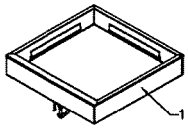
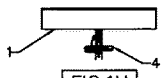
FIG.1U
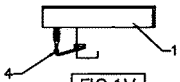
FIG.1V MOBILE INSULATED DISPLAY TABLE – MIT– M
FIG.1W
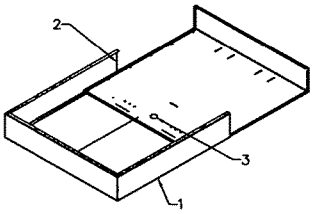
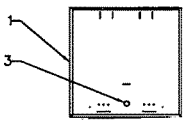
FIG.1Y
FIG.1X
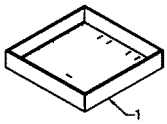
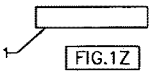
FIG.1Z

SELF-SERVICE KIT - SSKT 11
10

11
10

10
11

11
10

12

12

12

12

10
12

11
12

11
12

CANOPY KIT – CKT 14
13
15

14
13
15

14
13
14

13
14
13
15

FULL SERVICE KIT – FSKT 21
20
19

21
19
20

21
19
18
17
16

21
16
17
18
20

12

12

12

12

19
21
16
17
18

21
19
16
17
18

19
21
16
17
18

HALF CANOPY KIT – HCKT 22
25
25
24
22
25
23
22
26

MODULAR CLAM BAR /
DRY SHELF KIT – MCB 27
29
30

27
29
28

30

30

27
29
30

29
27
30

27
28
29
30

OYSTER SHUCKING
STATION KIT – OSKT 39
33
32
31

39
33
32
31

32
33

32
33
36
34
31
35
37
39

31
38
33
32
31
39

MEAT CUTTING KIT – MCKT 42
41
40

42
40
41
44
40
45

46
43
43A 40
41
42

42
40
41

42
40
41

42
40
41

SAUSAGE GRINDING KIT – SGKT 47
48

48
47

SMOOTHIE KIT – SMKT 52
50
53

52
53
49

52
53

52

STEPPED DRY INSERT KIT – SDIKT

56

SKIRT KIT – WSKT

SKIRT KIT – WSKT 58
57

58
57

57
58

SKIRT KIT – WSKT

SKIRT KIT – WSKT

SKIRT KIT – WSKT 57
58

58
57

SCALE STAND KIT – SS
60
59
61
62

59
61
63
62

59
63

60
59
63

59
60
61
62
63
59
60

CUTTING BOARD WITH INTEGRAL WRAP PAPER ROLL HOLDER KIT – CWP 67
64
66

65
66

65
67
64

65
66

CUTTING BOARD DROP SHELF KIT–DSKP

70

70

70
71
69
68

70
68

70

69

70
69
68

69

CHEF DEMO MIRROR KIT – CDMKT

SQUARE DRY STEP INSERT KIT – SDSKT
ALT #1
ALT #2
ALT #3

75

75

75

PYRAMID INSERT KIT – PMDKT

77

76

77

77

TRIPLE DRY SIDE SHELF
KIT– TDSSKT 78
79

79
78

79
78
78

78

DEEP LEDGE KIT- DLKT

81

80

80

80

81

80

TRIPLE DRY CORNER SHELF
KIT- TDCSKT 83
82

82

83

83
82

82

DRY HANGING DISPLAY BOX
KIT– DHDBKT 85
84

85

84

85
84

STAINLESS STEEL DROP
SHELF KIT– DSK 88
86

88
86

88
86

86
86
88
87

WRAP PAPER ROLL HOLDER KIT– WPKT 89
89

89

89

90

89

89

89

TRASH RECEPTACLE KIT– TRKT

KNIFE HOLDER KIT– KHKT

PAPER TOWEL HOLDER
KIT–PTHKT

98

97
96

98

96
97

98

SAFETY STEP KIT – DPSI

101

103
99
102
101
100
103

103
99
102
101
100

103
99
100
REAR STEPS

Example Merchandising Display Case (Prior Art)

Example Merchandising Display Case

Example Merchandising Display Case (Prior Art)

Example Merchandising Display Case (Prior Art)

Example Merchandising Display Case

FRESH FOOD AND DRY GOODS FOODSERVICE MERCHANDISING DISPLAY CASE WITH INTERCHANGEABLE KIT UTILITY SYSTEM

CROSS-REFERENCE TO RELATED APPLICATIONS

Application is based on U.S. Provisional Application Ser. No. 62/140,981, which was filed on Mar. 31, 2015, and is entitled "Fresh food and dry goods merchandising display case with interchangeable kit system which expands utility for use in a wide variety of foodservice and supermarket departments," the disclosure of which is hereby incorporated by reference and on which priority is hereby claimed.

BACKGROUND OF THE INVENTION

There are budgetary restraints on foodservice and supermarket capital expenditures that preclude operators from buying multiple merchandisers to sell different items. No merchandising case exists that allows foodservice and supermarket operators to easily change functionality with interchangeable kits and parts so that they may sell different products in different departments from one case. The invention claimed here solves this problem.

Merchandising cases stay in one place with set functions and merchandise the same things. It would take up to 10 different style cases currently available in the marketplace to perform all of the functions this system performs. The claimed invention differs from what currently exists. This case and its interchangeable kits eliminate the need for foodservice and supermarket operators to buy multiple cases with different functions to sell different products in different departments. As it is intended for use in public shopping areas, it also provides sanitation features not normally found anywhere other than in employee work spaces.

Merchandising equipment for foodservice and supermarket operators provide singular functions and cannot be easily changed to merchandise different products as desired in different departments. Therefore, multiple equipment purchases are required. Supermarkets can't use bakery tables to merchandise produce, or produce tables to merchandise seafood, or seafood tables to function as a rolling butcher shop for meat and poultry, or a butcher table to shuck clams or oysters, or a shucking table to merchandise bottled drinks on ice, or an ice table to display bakery items.

This system performs the multiple functions outlined herein, saving money, preserving space, and increasing sales, by allowing for the purchase of a single case with kits that are easily fitted onto and off the case that change the functionality. This one case can be moved into different departments and fitted with different kits to sell different things.

This merchandising case has multiple interchangeable kits and parts that provide changing functionality for sales of products in different foodservice and supermarket departments. The kits allow the operator to change the case from a range of self service and full service functions with minimal or no tools required. Operators can thereby change the kit as desired to use the same piece of equipment in different departments to sell many different products ranging from cut meat, poultry, seafood, shucked oysters, sausages, produce, bakery, groceries, floral, juice, general merchandise and more.

In addition, food retailers are challenged by high occupancy costs per square foot, and therefore they must make decisions regarding what types of merchandising they can fit into their floor plan and which will not. Further, storage space in supermarkets and food retailers is even more restricting, therefore, whatever can stay on the sales floor and out of the back room is a blessing to retailers. Labor reduction is one of the 2 biggest hot buttons for supermarkets. Moving this system from department to department is more efficient than sending it into the storage area at the end of any given day, and retrieving it the next day. As the kits are designed specifically so they do not require tools to install or remove, there is nothing to impede the interchangeable kit change over, which typically take 1-2 minutes. This is also important to retailers, whose staff is not necessarily mechanically competent to use tools, and tools are not typically on site.

In the accompanying example of a merchandising display case FIG. 29A-29Z (Prior Art), which is commonly used in the foodservice and supermarket industry independently with a singular function, the depicted merchandiser generally has a base that is constructed of as many as 12 cut steel tubes, which are welded together to create a base frame, whereby each tube has to be notched, coped, deburred and polished, then welded together so that a final grinding and polishing process can finish the base. That entire fabrication process is very costly, labor intensive, material intensive and yields a "busy" look and an unnecessarily heavy base. In addition, it creates more joints that are subject to cracking or breaking, and which accumulate dirt. The new base design claimed in this invention reduces 12 straight tubes to 4 bent tubes, reducing the weight, visual confusion, labor, material, risk of breakage, and dirt accumulation. This new base design has been tested to hold 500 lbs., which far exceeds the possible weight of the loaded case.

These and other aspects, features and advantages of the present invention will become better understood in conjunction with the reading of the following detailed description of illustrative embodiments thereof, appended claims, and accompanying drawings.

BRIEF DESCRIPTION OF THE DRAWINGS

FIG. 1A-1K are Isometric, Plan, Front and Cross Section Views of the Mobile Insulated Display Table ("MIT-M") in varying degree pitch positions by itself and next to a 64" tall customer.

FIG. 1L-1O are Separated Isometric, Front and Cross Section Views of the Tubular Support Structure and the Insulated Bin Assembly of the Mobile Insulated Display Table ("MIT-M").

FIG. 1R-1Z are Separated and Assembled Isometric, Plan, Front and Cross Section Views of the Insulated Bin Assembly of the Mobile Insulated Display Table ("MIT-M").

FIG. 27F-27G are Plan and Cross Section Views of the Rolled Tube Piece of the Paper Towel Holder Kit ("PTHKT").

FIG. 27H-27I are Rear and Cross Section Views of the Paper Towel Holder Kit ("PTHKT").

FIG. 28A-28G are Isometric, Plan, and Cross Section Views of the Safety Step Kit ("DPSI") by itself and installed on the Mobile Insulated Display Table.

FIG. 29A-29B are Exploded and Assembled Isometric Views of an example merchandising display case in a full-service configuration (Prior Art).

FIG. 29C-29D are Isometric Views of an example merchandising display case in a tilted and flat self-service configuration with a front skirt (Prior Art).

FIG. 29E is a Plan View of the underside of an example merchandising display case (Prior Art).

FIG. 29F-29H are Plan, Side and Front Elevation Views of an example merchandising display case (Prior Art).

FIG. 29I-29K are Cross Section Views of an example merchandising display case in flat, intermediate, and full-tilt position (Prior Art).

FIG. 29L-29M are Plan and Isometric Views of the tubular support structure of an example merchandising display case (Prior Art).

FIG. 29N is a Plan View of the underside of the pan display area of an example merchandising display case (Prior Art).

FIG. 29O-29P are Front and Side Elevation Views of the tubular support structure of an example merchandising display case (Prior Art).

FIG. 29Q is a Plan View of the pan display area of an example merchandising display case (Prior Art).

Figure 29A:
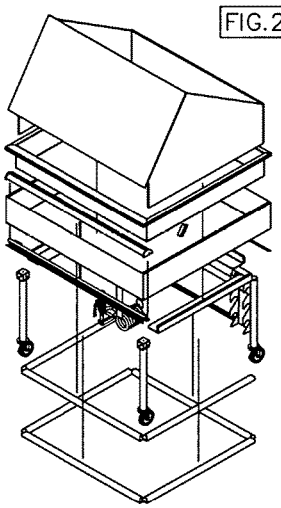
Figure 29B:
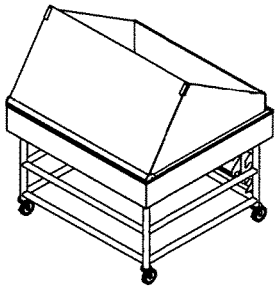
Figure 29C:
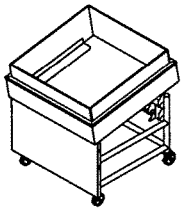
(Prior Art) FIG. 29C
Figure 29D:
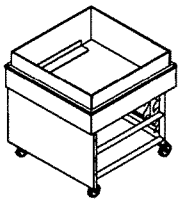
Figure 29E:
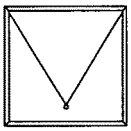
Figure 29F:
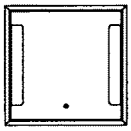
Figure 29G:
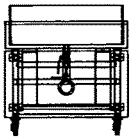
Figure 29H:
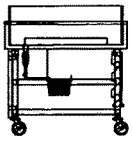
Figure 29I:
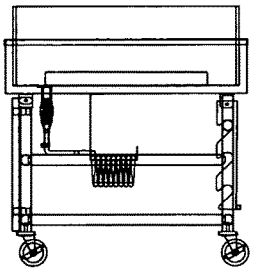
Figure 29J:
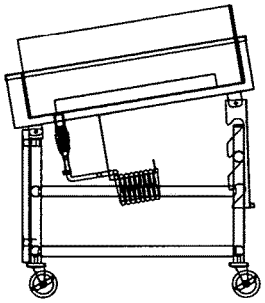
Figure 29K:
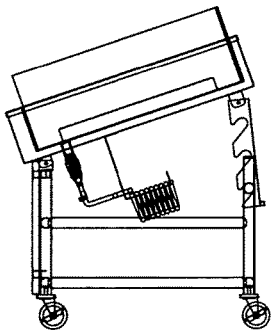
Figure 29L:
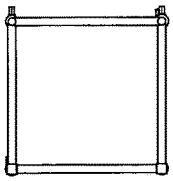
Figure 29M:
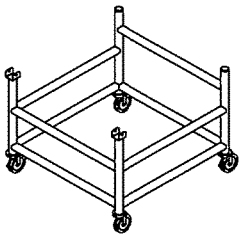
Figure 29N:
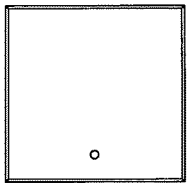
Figure 29O:
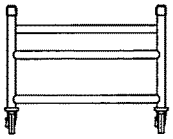
Figure 29P:
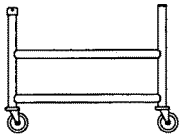
Figure 29Q:
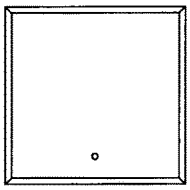
Figures 29R, 29S, 29T, 29U, 29V, 29W, 29X, 29Y, 29Z:
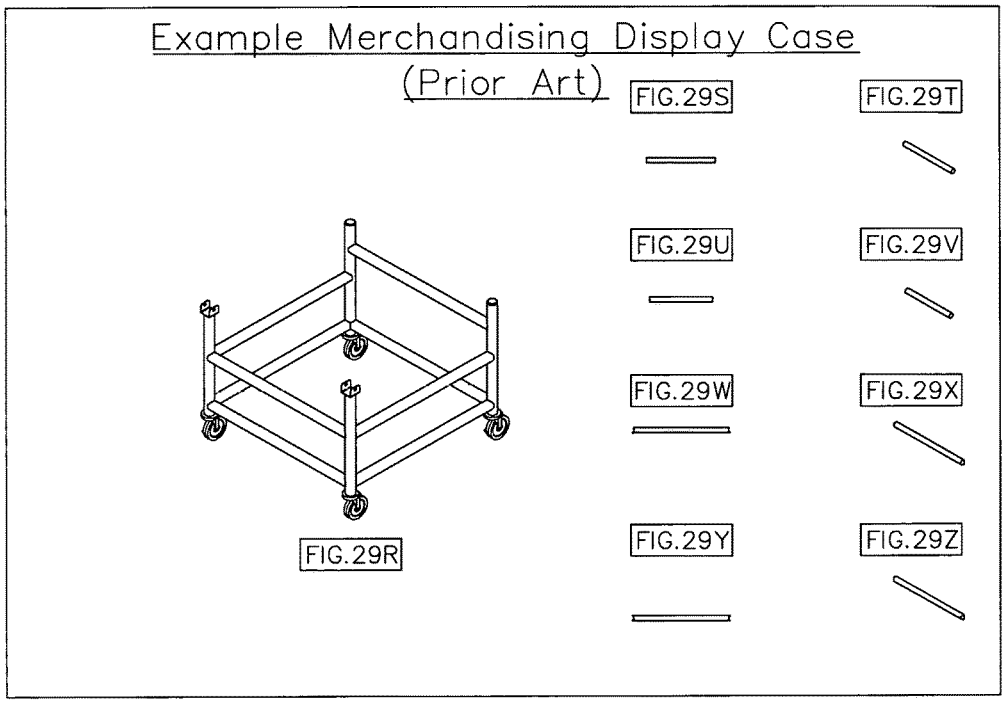
(Prior Art) FIG.29S

FIG. 29R is an Isometric View of the tubular support structure of an example merchandising display case (Prior Art).

FIG. 29S-29T are Cross and Isometric Views of the rear leg of the tubular support structure of an example merchandising display case (Prior Art).

FIG. 29U-29V are Cross and Isometric Views of the front leg of the tubular support structure of an example merchandising display case (Prior Art).

FIG. 29W-29X are Cross and Isometric Views of the lower bar bracing of the tubular support structure of an example merchandising display case (Prior Art).

FIG. 29Y-29Z are Cross and Isometric Views of the upper bar bracing of the tubular support structure of an example merchandising display case (Prior Art).

DETAILED DESCRIPTION OF THE INVENTION

Some of the embodiments of the present invention are discussed below. As the present invention may be embodied in several forms without departing from the spirit or essential characteristics thereof, it should be understood that the description contained herein is not limited by the details of the foregoing description, unless otherwise stated. The present invention should be construed within its spirit and scope, and therefore all changes and modifications that fall within the meets and bounds of the claims, or equivalences of such meets and bounds are therefore intended to be embraced by the invention.

Figure 1A:
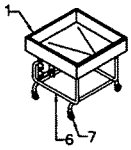
Figure 1B:
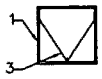
Figure 1C:
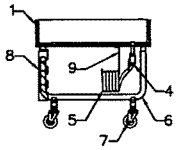
Figure 1D:
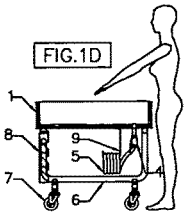
Figure 1E:
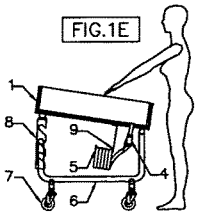
Figure 1F:
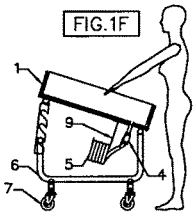
Figure 1Q:
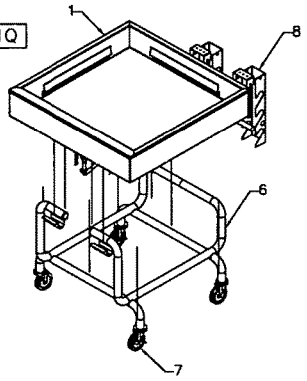
FIG. 1Q is an Isometric View of the Tubular Support Structure and the Insulated Bin Assembly of the Mobile Insulated Display Table ("MIT-M").
Figure 1P:
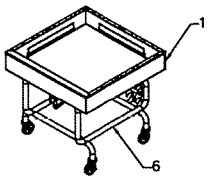
FIG. 1P is an Isometric View of the Mobile Insulated Display Table ("MIT-M").
Figures 2A, 2B, 2C, 2D, 2E, 2F, 2G, 2H, 2I, 2J, 2K, 2L:
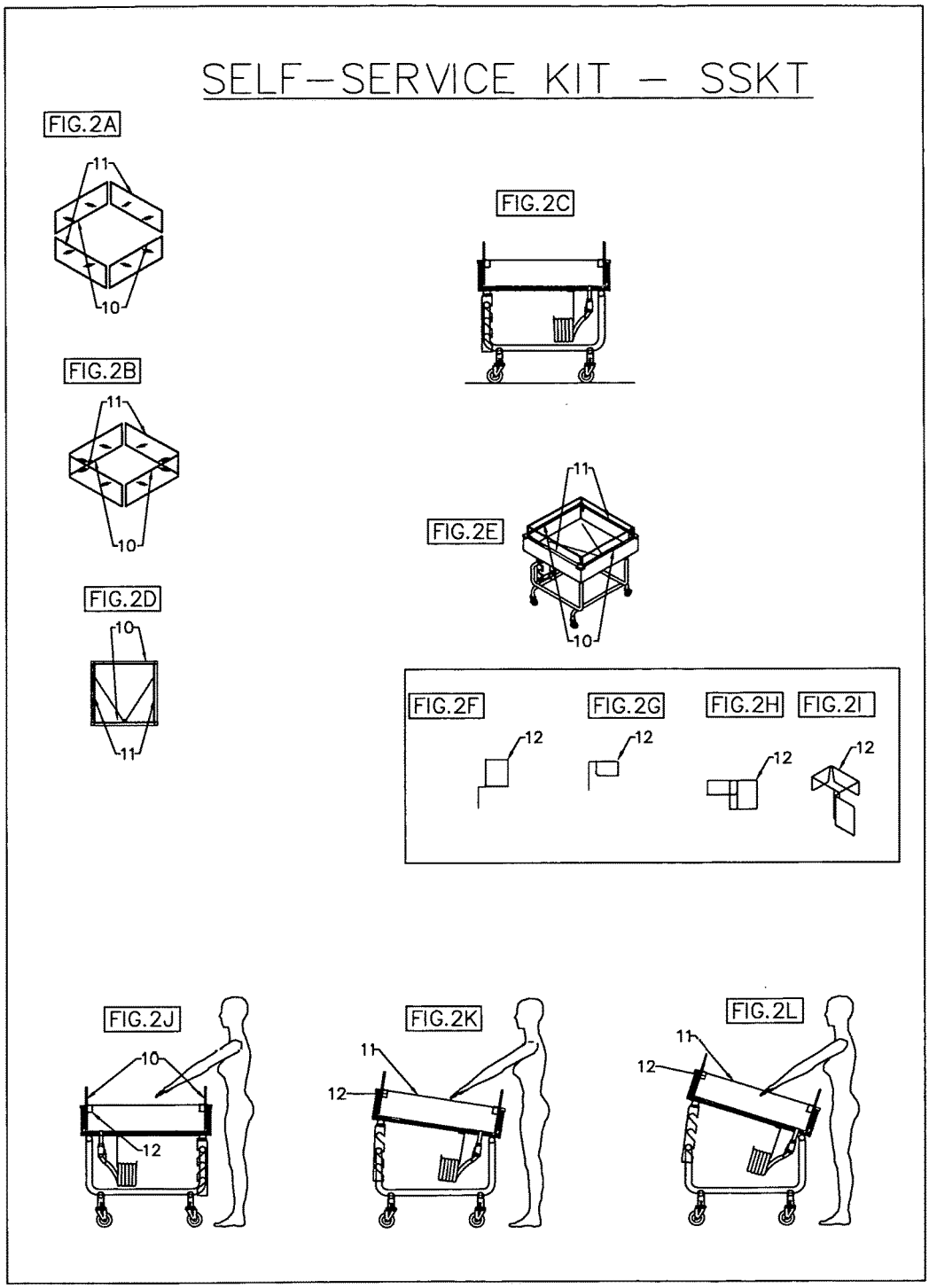
FIG. 2A is an Isometric View of the Self-Service Kit ("SSKT").
FIG. 2B is a Cross Section View of the Self-Service Kit ("SSKT") installed on the Mobile Insulated Display Table in 0 degree pitch position.
FIG. 2C is an Isometric View of the Self-Service Kit ("SSKT").
FIG. 2D-2E are Plan and Isometric Views of the Self-Service Kit ("SSKT") installed on the Mobile Insulated Display Table.
FIG. 2F-2I are Detailed Plan, Front, Cross and Isometric Views of the Stainless Steel Retention Clips that hold the Self-Service Kit ("SSKT") in place on the Mobile Insulated Display Table.
FIG. 2J-2L are Cross Section Views of the Self-Service Kit ("SSKT") installed on the Mobile Insulated Display Table in 0, 9 and 18 degree pitch position next to a 64" tall customer.
Figures 3A, 3B, 3C, 3D, 3E, 3F:
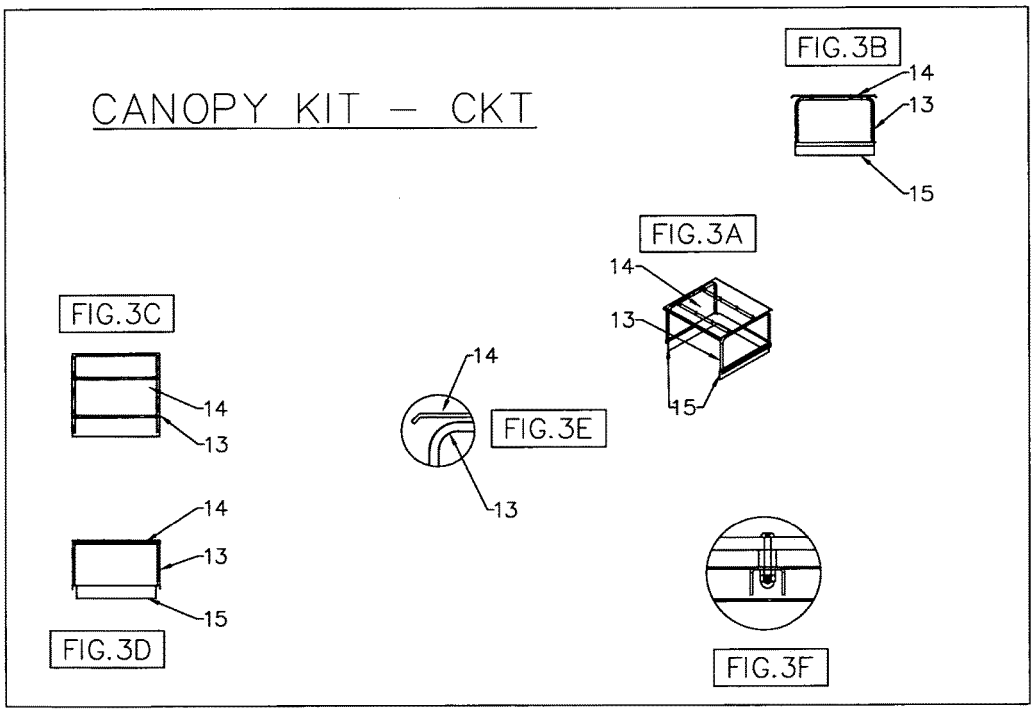
FIG. 3A-3D are Isometric, Plan, Elevation and Cross Section Views of the Canopy Kit ("CKT").
FIG. 3E-3F are Detail Views of the overhang bend of the Top Polymer Panel of the Canopy Kit ("CKT").
Figures 4A, 4B, 4C, 4D, 4E, 4F, 4G, 4H, 4I, 4J, 4K, 4L:
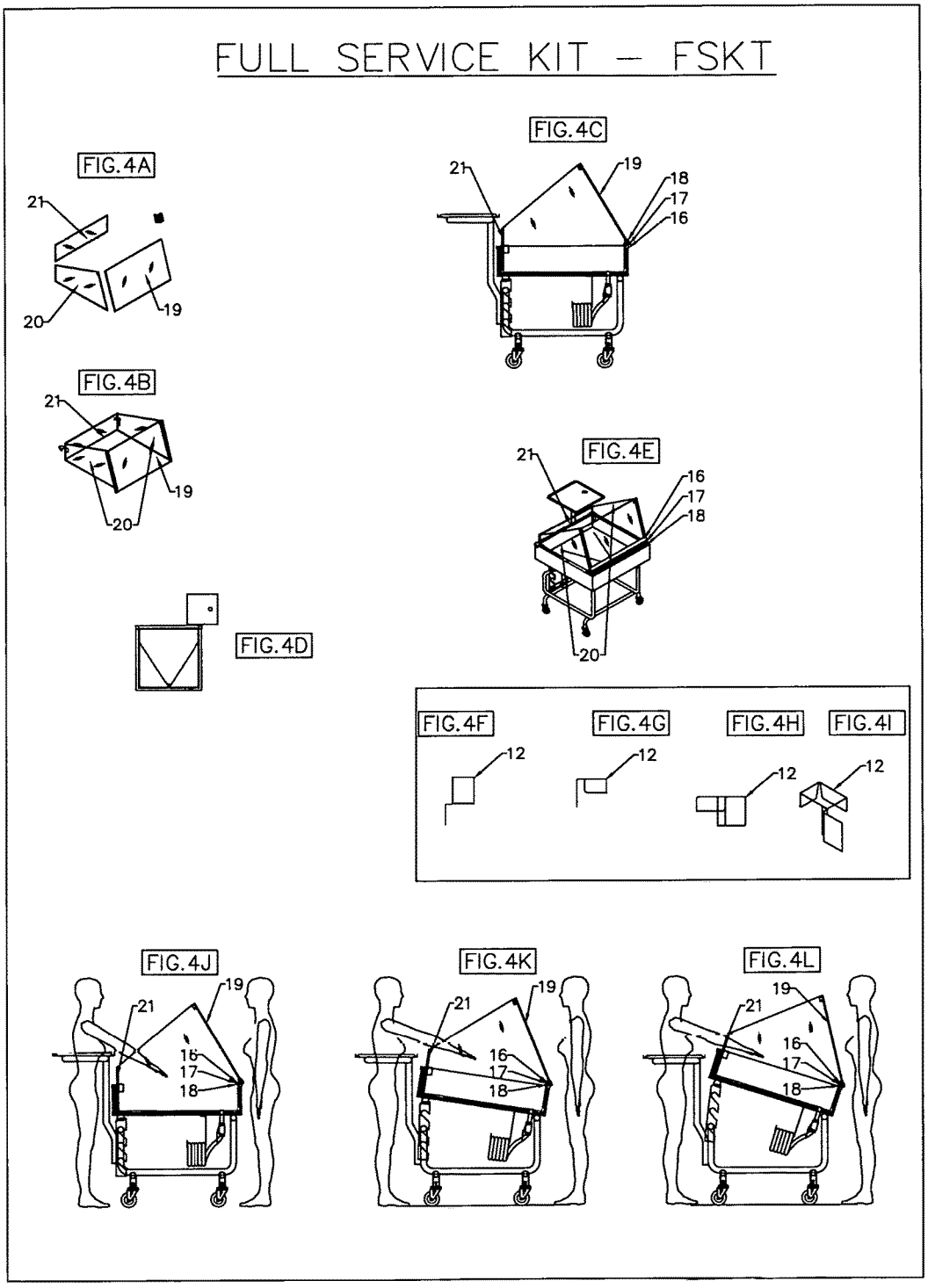
FIG. 4A-4B are Isometric Views of the End Polymer Panels and Tempered Front Glass Panels Parts of the Full-Service Kit ("FSKT").
FIG. 4C-4E are Isometric, Plan, and Cross Section Views of the Full-Service Kit ("FSKT") and the Scale Stand Kit ("SS") installed on the Mobile Insulated Display Table in 0 degree pitch position.
FIG. 4F-4I are Isometric, Plan, Front and Cross Section Views of the Stainless Steel Retention Clips that hold the Full-Service Kit ("FSKT") in place on the Mobile Insulated Display Table.
FIG. 4J-4L are Cross Section Views of the Full-Service Kit ("FSKT") and Scale Stand Kit ("SS") installed on the Mobile Insulated Display Table in 0, 9, and 18 degree pitch positions in between a 64" tall customer and a 64" employee servicing the case.

We refer initially to FIG. 1A-1Z, showing the Mobile Insulated Display Table ("MIT-M"). It is designed in 3D modeling software, which is programmed to instruct a CNC laser, CNC punch, CNC plasma, and CNC hydraulic brake to cut and form the parts. Parts are then welded using heliarc welding equipment, then deburred and ground to eliminate sharp edges, then polished by hand to its final finish. The table features a crossbreak liner to drain, and is insulated with a double wall stainless steel liner 1, the space between which is filled with polystyrene insulation 2. A drain 3 is installed, and the valve 4 and drain hose 5 attached and insulated. Then the assembly is mounted on support base 6 made of 1⅝" diameter 16 gauge stainless steel tubing bent precisely with a CNC tubing bending machine. They are then coped with a milling machine, then heliarc welded, then ground, then polished, and finally heavy-duty locking casters 7 are installed. The precise 90 degree bend of the tubing of the support base 6 on precisely 3⅜" centers allows it to retain a crush-proof bend, leaving the tubing in its maximum strength. Designing the downward facing tubes to have these 3⅜" centers also allows the upward facing tube to be welded to the base tube in a location that assures a perfect center of gravity, making the Mobile Insulated Display Table stable and tip-resistant.

The MIT-M FIG. 1A-1Z can range in size from 12" long to 180" long with otherwise identical designs and functions. It is precisely dimensioned to accept all component kits, and has fully welded construction, corrosion-resistant 304 stainless steel construction, a fully welded bent tubular steel frame 6, an adjustable tilting mechanism 8 with 3 positions, a welded stainless steel drain 3 and a shutoff valve 4 with a 5' insulated drain hose 5 and a hose hanging bracket 9.

FIG. 2A-2L shows the Self-Service Kit ("SSKT"). This removable kit is comprised of 6 components including: 2 each 11" high×32" wide×⅜" thick scratch resistant polymer with polished edges (front and rear risers) 10, 2 each 11" high×31⅛" wide×⅜" thick scratch resistant polymer with polished edges (left and right side risers) 11, and 2 custom designed stainless steel retention clips 12 which hold polymer panels in place while allowing removal without the use of tools. Polymer panels 10-11 are sized so when placed into case, they lock together with the help of the stainless steel retention clip 12.

FIG. 3A-3F shows the Canopy Kit ("CKT"). This removable kit is comprised of a removable welded stainless steel tubular structure 13 with a permanently mounted clear polymer top 14. It includes fitted brackets 15 to allow the canopy to be installed with complete stability and removed without tools or hardware.

FIG. 4A-4L shows the Full-Service Kit ("FSKT"). This removable kit is comprised of 8 components including: an aluminum front hinge base plate 16 permanently attached to a removable stainless steel mounting bracket 17, an aluminum glass clamp (affixed to glass) 18, a tempered glass panel 19, 2 tall scratch resistant side polymer panels with polished edges 20 with 2 custom designed stainless steel retention clips 12 which hold polymer panels firmly in place abutting the front glass 19, 2 custom designed stainless steel retention clips 12 which stabilize the side polymer panels 20 and locks them in place with the rear polymer panel 21, which is 11" high×32" wide×⅜" thick scratch resistant polymer with polished edges. Entire kit is designed to be installed and removed without any tools or hardware.

Figures 5A, 5B, 5C:
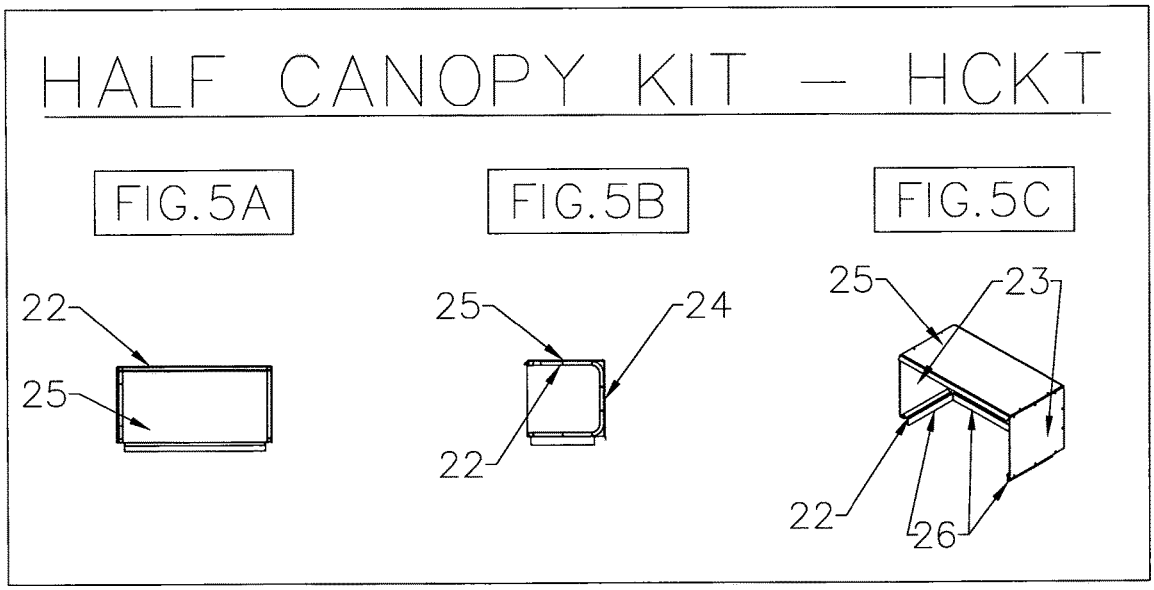
FIG. 5A-5C are Isometric, Plan, and Cross Section Views of the Half Canopy Kit ("CKT").
Figures 6A, 6B, 6C, 6D, 6E, 6F, 6G:
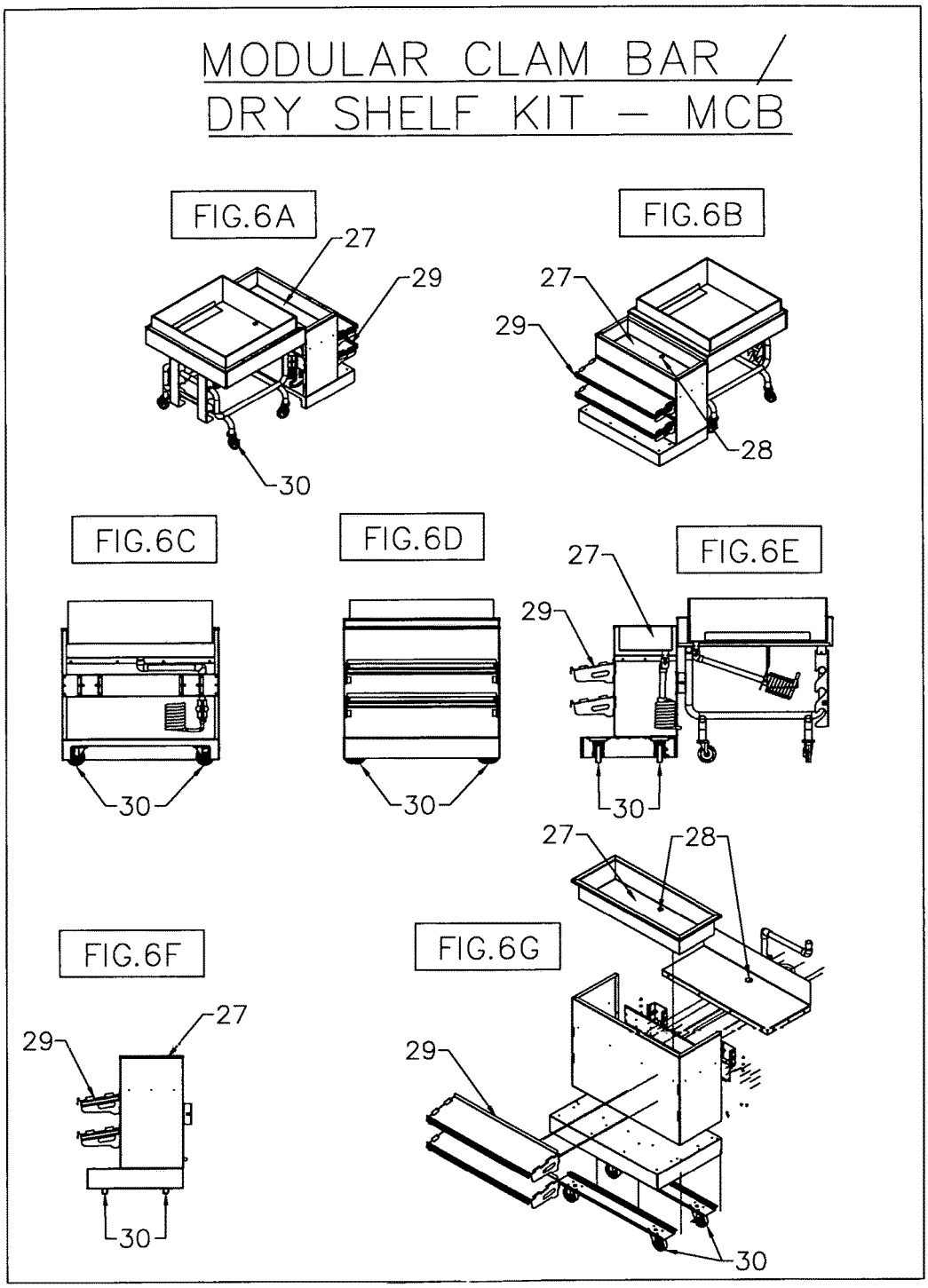
FIG. 6A-6G are Isometric, Separated, Side, Elevation and Cross Section Views of the Modular Clam Bar/Dry Shelf Kit ("MCB").
Figures 7A, 7B, 7C, 7D, 7E, 7F, 7G:
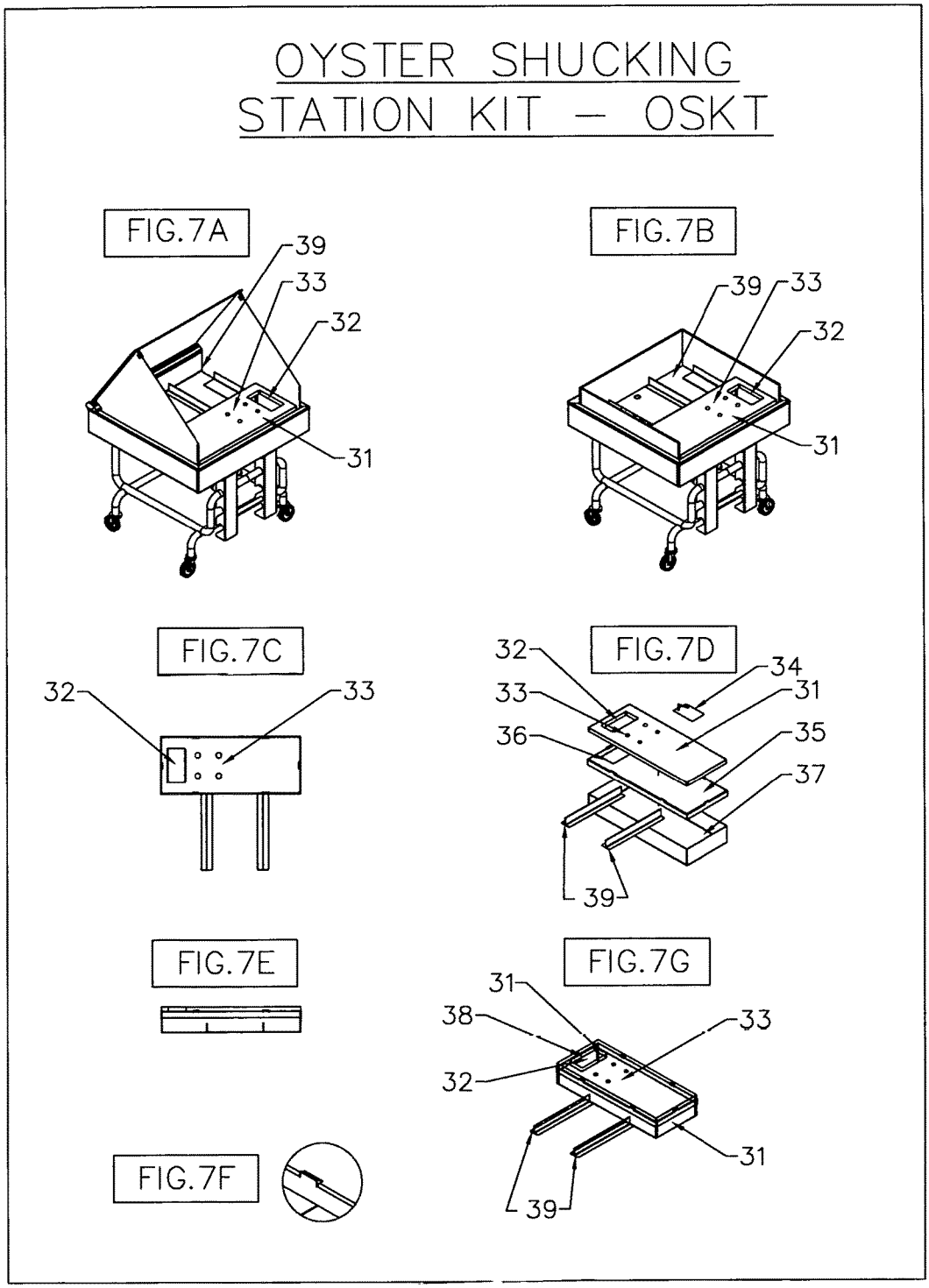
FIG. 7A is an Isometric View of the Oyster Shucking Station Kit ("OSKT") and the Full-Service Kit ("FSKT") installed on the Mobile Insulated Display Table.
FIG. 7B is an Isometric View of the Oyster Shucking Station Kit ("OSKT") and the Self-Service Kit ("SSKT") installed on the Mobile Insulated Display Table.
FIG. 7C-7E are Separated and Assembled Isometric, Plan, and Side Views of the Oyster Shucking Station Kit ("OSKT").
FIG. 7F is a Detailed View of the tabs that keep the scrap pan, scrap pan cover, and removable polymer board in place on the Oyster Shucking Station Kit ("OSKT").
FIG. 7G is an Isometric View of the Oyster Shucking Station Kit ("OSKT").
Figures 8A, 8B, 8C, 8D, 8E, 8F, 8G, 8H, 8I, 8J, 8K, 8L:
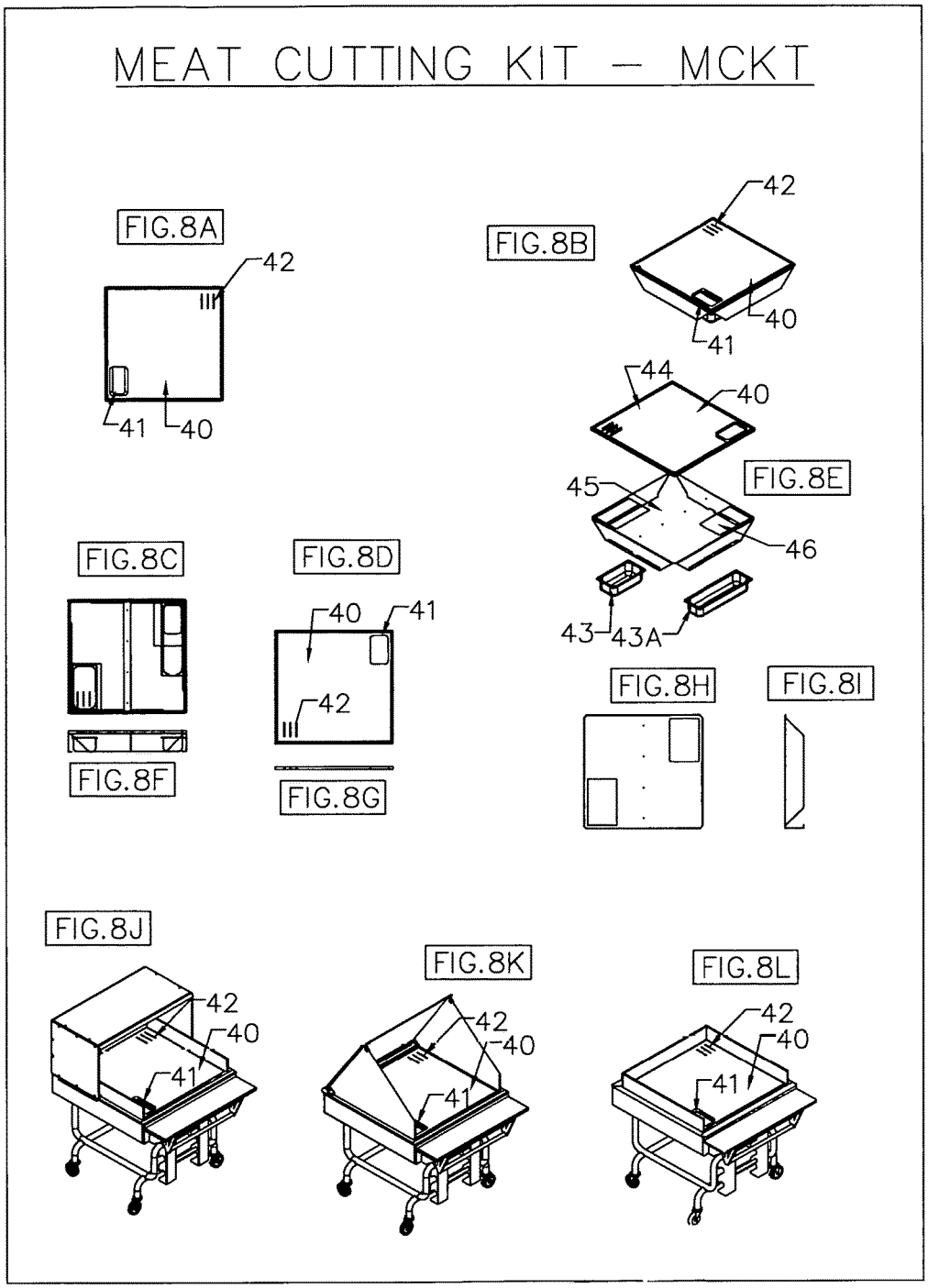
FIG. 8A is a Plan View of the Meat Cutting Kit ("MCKT").
FIG. 8B is an Isometric View of the Meat Cutting Kit ("MCKT").
FIG. 8C-8D are Plan Views of the Meat Cutting Kit ("MCKT") with and without its Polymer Top installed.
FIG. 8E is a Separated Isometric View of the Meat Cutting Kit ("MCKT").
FIG. 8F is a Cross Section View of the Meat Cutting Kit ("MCKT").
FIG. 8G is a Cross Section View of the Polymer Board Top of the Meat Cutting Kit ("MCKT").
FIG. 8H is a Plan View of the 14 Gauge 304 Stainless Steel Base of the Meat Cutting Kit ("MCKT").
FIG. 8I is a Rotated Side View of the 14 Gauge 304 Stainless Steel Base of the Meat Cutting Kit ("MCKT").
FIG. 8J is an Isometric View of the Meat Cutting Kit ("MCKT") installed on the Mobile Insulated Display Table, along with the Half-Canopy Kit ("HCKT"), the Self-Service Kit ("SSKT"), and the Cutting Board Drop Shelf Kit ("DSKP").
FIG. 8K is an Isometric View of the Meat Cutting Kit ("MCKT") installed on the Mobile Insulated Display Table, along with the Full-Service Kit ("FSKT") and the Cutting Board Drop Shelf Kit ("DSKP").
FIG. 8L is an Isometric View of the Meat Cutting Kit ("MCKT") installed on the Mobile Insulated Display Table, along with the Self-Service Kit ("SSKT") and the Cutting Board Drop Shelf Kit ("DSKP").
Figures 9A, 9B, 9C, 9D, 9E, 9F, 9G, 9H, 9I:
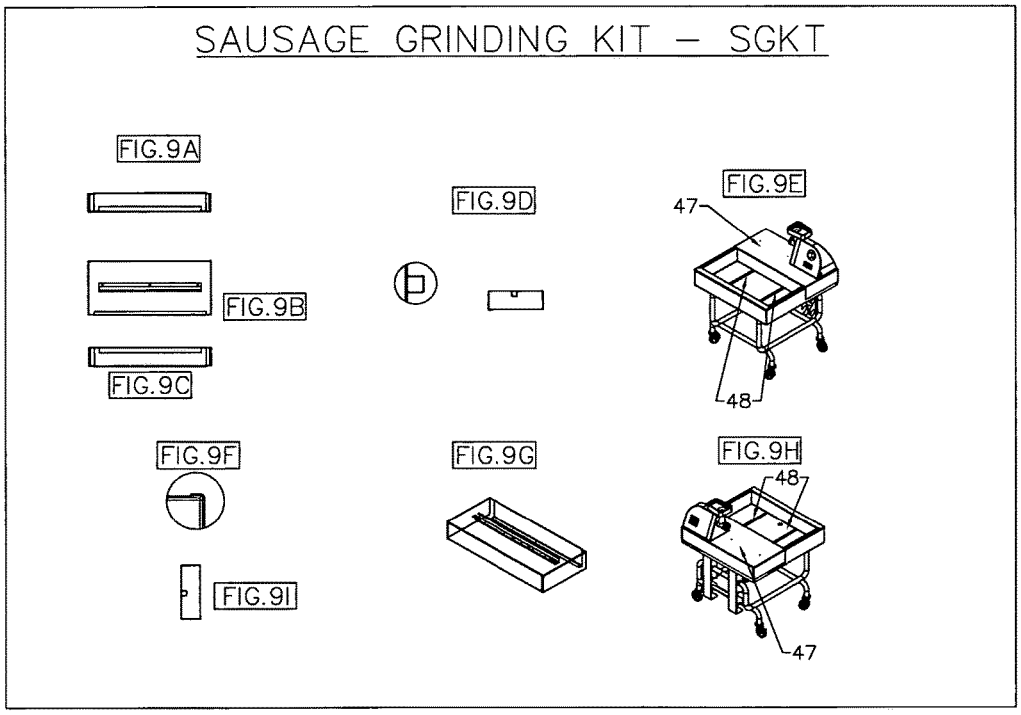
FIG. 9A-9I are Isometric, Rear, Inverted, Plan, and Cross Section Views of the Sausage Grinding Kit ("MCKT") by itself and installed on the Mobile Insulated Display Table.
Figures 10A, 10B, 10C, 10D, 10E, 10F, 10G, 10H, 10I, 10J, 10K, 10L, 10M:
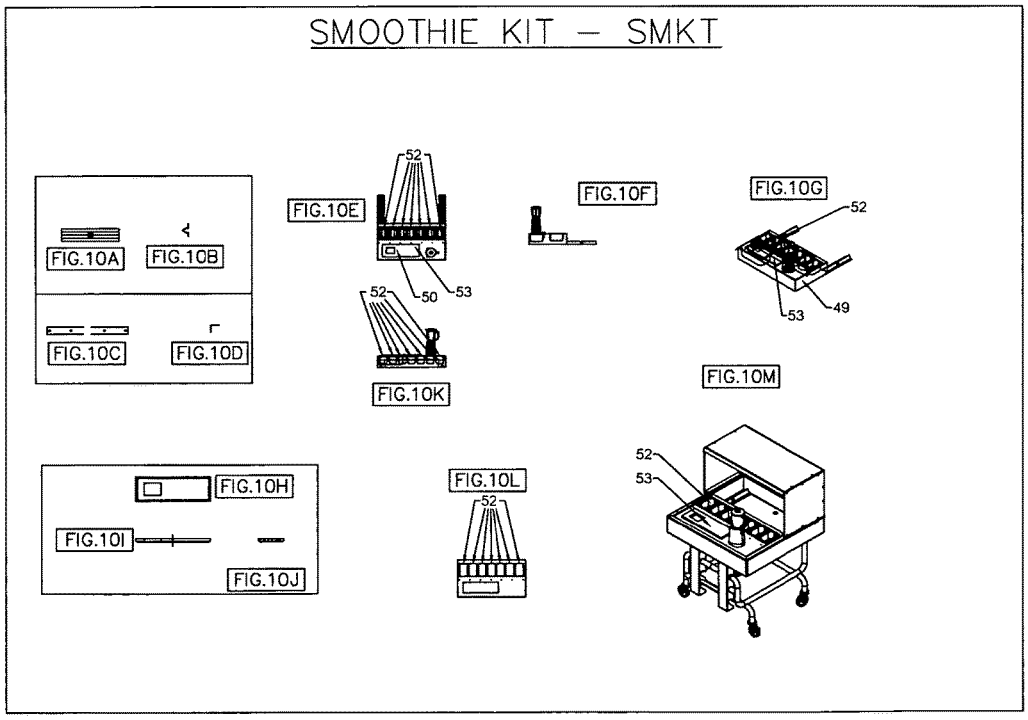
FIG. 10A-10B are Side and Plan Views of one of the two Slider Brackets of the Smoothie Kit ("SMKT").
FIG. 10C-10D are Plan and Cross Section Views of the Base Support for one of the two Slider Brackets of the Smoothie Kit ("SMKT").
FIG. 10E-10G are Isometric, Plan and Cross Section Views of the Smoothie Kit ("SMKT").
FIG. 10H-10J are Front, Plan and Cross Section Views of the Polymer Board Top of the Smoothie Kit ("SMKT").
FIG. 10K is a Cross Section View of the Smoothie Kit ("SMKT").
FIG. 10L is a Plan View of the Steel Support Structure of the Smoothie Kit ("SMKT").
FIG. 10M is an Isometric View of the Smoothie Kit ("SMKT") and the Half-Canopy Kit ("HCKT") installed on the Mobile Insulated Display Table.

FIG. 5A-5C shows the Half Canopy Kit ("HCKT"). This removable kit is comprised of a removable welded stainless steel structural frame 22 supporting 2 sided polymer breath protection guards 23, a front 24 and a top 25 made of clear polymer. Entire assembly is affixed to 3 stainless steel mounting brackets 26, designed to be installed and removed without tools or hardware.

FIG. 6A-6G shows the Modular Clam Bar/Dry Shelf Kit ("MCB"). This modular kit is comprised of a fully welded corrosion resistant insulated stainless steel ice trough 27 with integral drain 28 and hanging shelves 29, mounted on casters 30 for easy mobility. Designed to appear to be integrated into base MIT-M FIG. 1A-1Z.

FIG. 7A-7G shows the Oyster Shucking Station Kit ("OSKT"). This removable kit is comprised of 7 components including: a poly cutting board 31 with scrap chute 32 and pre-drilled holes 33 for mounting the oyster shucking machine 34, a stainless steel top 35 with cutout 36 to align with chute 32 in the poly cutting board 31, a stainless steel base 37 and a removable stainless steel scrap pan 38 plus 2 anti-slip stainless steel retention brackets 39 to keep the oyster shucking machine in place.

FIG. 8A-8L shows the Meat Cutting Kit ("MCKT"). This removable kit is comprised of 5 components including: a poly chopping block 40 with a scrap chute pass-through 41 and knife retention safety slots 42, a stainless steel drip pan 43 with poly liner 44 to collect runoff of knives and protect blades when in storage, 14 gauge stainless steel support platform 45 with a scrap chute 46 to align with the chopping block 40, a stainless steel scrap tray 43A that is sized to fit inside of the stainless steel support platform 45 below the scrap chute 46. The stainless steel scrap tray 43A and the poly chopping block 40 are designed to be reversible, allowing instant changeover for a left-handed butcher, from a right-handed butcher, without any additional hardware, brackets or other bacteria harboring parts. The 14 gauge stainless steel support platform 45 has matching, offset knife retention safety slots cutouts 42 so the poly chopping block 40 can be flipped, moving the knife holding rack function from right to left, to accommodate right or left-handed butchers. The 14 gauge stainless steel support platform 45 is exactly 31⅞" wide×32½" deep, allowing the precise clearance of 3/32" on the left and right, which provides exactly enough pressure to the components of other compatible accessory kits disclosed herein to hold them firmly in place on the Mobile Insulated Display Table, without additional hardware or bacteria harboring parts, and prevent them from moving or accidentally falling off the Mobile Insulated Display Table. This critical tolerance allows the user to simultaneously utilize and secure other accessory kits, such as the Self-Service Kit, Full-Service Kit, Canopy Kit, and Half-Canopy Kit, on the Mobile Insulated Display Table. The 14 gauge stainless steel support platform 45 has three 10"×12" cutouts solely for the purpose of reducing the weight, without affecting the structural strength of the support. The knife retention safety slots 42 are 4" long×3/16" wide and designed to accommodate any knife up to the thickness of a chefs knife, with 1/32" radius corners to eliminate sharp edges that could cause injury. The poly chopping block 40 is cut with 1/32" radius outside corners to eliminate sharp edges that could injure an employee when removing it for cleaning. The poly chopping block 40 has a ⅛" wide×3/16" deep gutter that follows the entire perimeter of the board, ½" from the outside edge of the board, which has a drainage trough, routing any blood from the butchering into the stainless steel scrap tray 43A, keeping the double wall stainless steel liner 1 of the Mobile Insulated Display Table clean, and eliminating the chance of bacteria growth in the liner. The 14 gauge stainless steel support platform 45 is exactly 5⅛" tall, making the poly chopping block 40 exactly ⅛" lower than the upper rim of the double wall stainless steel liner 1 of the Mobile Insulated Display Table. This feature assures that any waste byproduct yielded from the butchering process has an obstacle to keep it on the top of the poly chopping block 40, and not fall onto the floor.

FIG. 9A-9H shows the Sausage Grinding Kit ("SGKT"). This removable kit is comprised of 3 components: a 14 gauge fully welded and braced grinder support structure 47 that fits into the MIT-M FIG. 1A-1Z, with 2 stainless steel retention brackets 48 to keep it in place.

FIG. 10A-10M shows the Smoothie Kit ("SMKT"). This removable kit is comprised of 10 components including: stainless steel base 49 with slider brackets to hold the kit firmly in place to prevent it from moving when installed on the table, with cutout 50 for scraps, and cutouts 51 for 7 stainless steel ingredient pans 52, a poly cutting board 53 with scrap chute 54 and a scrap pan 55.

Figures 11A, 11B, 11C, 11D, 11E, 11F, 11G, 11H, 11I, 11J, 11K, 11L, 11M, 11N, 11O, 11P, 11Q, 11R, 11S, 11T, 11U, 11V:
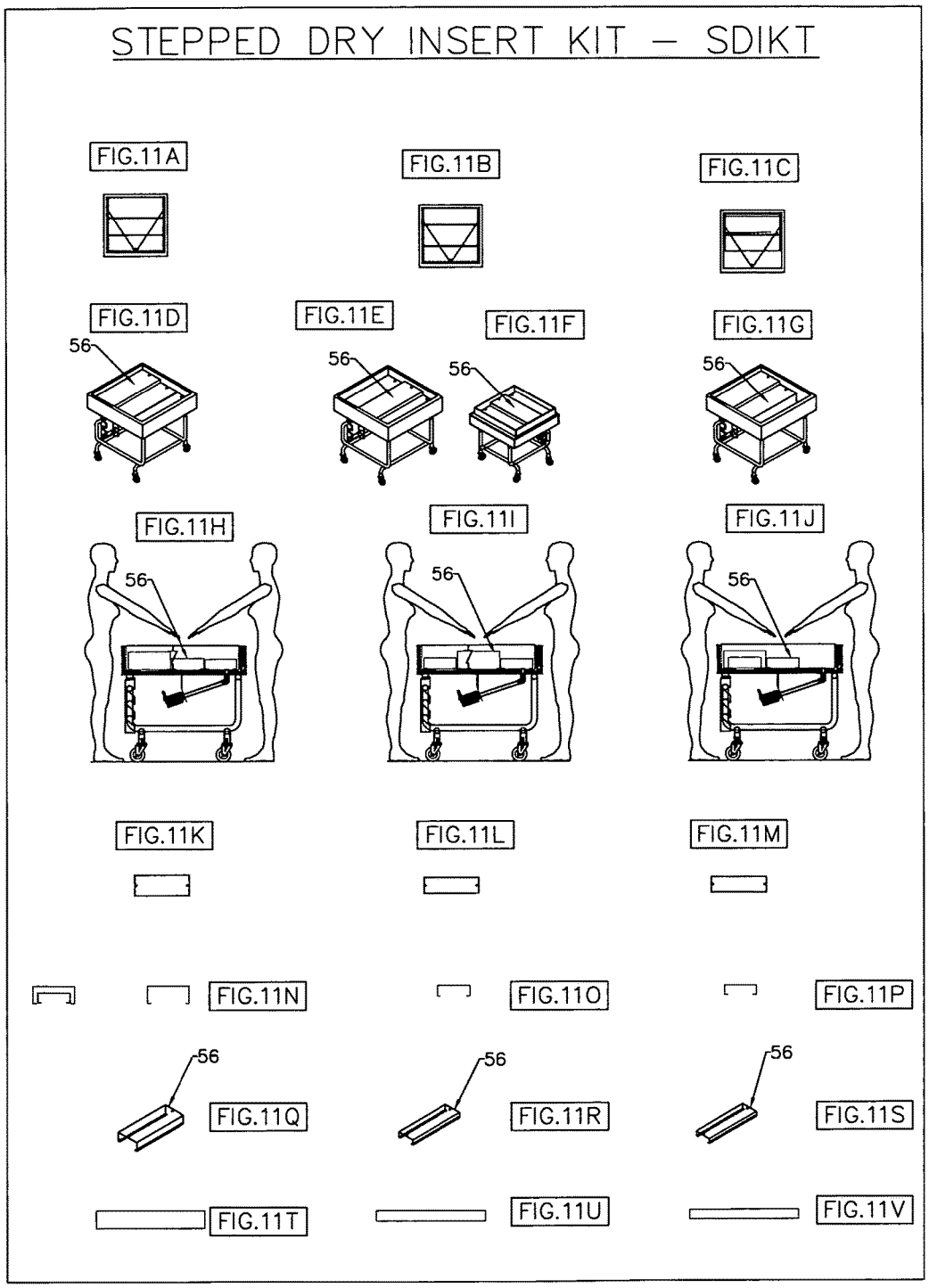
FIG. 11A-11C are Plan Views of the Stepped Dry Insert Kit ("SDIKT") in 3 different interchangeable configurations.
FIG. 11D-11G are Isometric Views of the Stepped Dry Insert Kit ("SDIKT") in 3 different interchangeable configurations installed on the Mobile Insulated Display Table.
FIG. 11H-11J are Cross Section Views of the Stepped Dry Insert Kit ("SDIKT") in 3 different interchangeable configurations installed on the Mobile Insulated Display Table in 0 degree pitch position in between two 64" tall customers.
FIG. 11K-11M are Separated Plan Views of the three Steps of the Stepped Dry Insert Kit ("SDIKT").
FIG. 11N-11P are Separated Short Cross Section Views of the three Steps of the Stepped Dry Insert Kit ("SDIKT").
FIG. 11Q-11S are Separated Isometric Views of the three Steps of the Stepped Dry Insert Kit ("SDIKT").
FIG. 11T-11V are Separated Long Cross Section Views of the three Steps of the Stepped Dry Insert Kit ("SDIKT").

FIG. 11A-11V shows the Stepped Dry Insert Kit ("SDIKT"). This removable kit is comprised of 3 different height, corrosion resistant stainless steel stepped platforms 56 that nest.

Figure 12A:
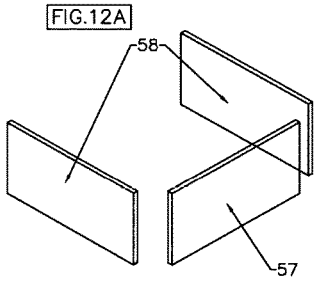
FIG. 12A-12B are Separated and Assembled Isometric Views of the Skirt Kit ("WSKT").
Figures 12B, 12C, 12D:
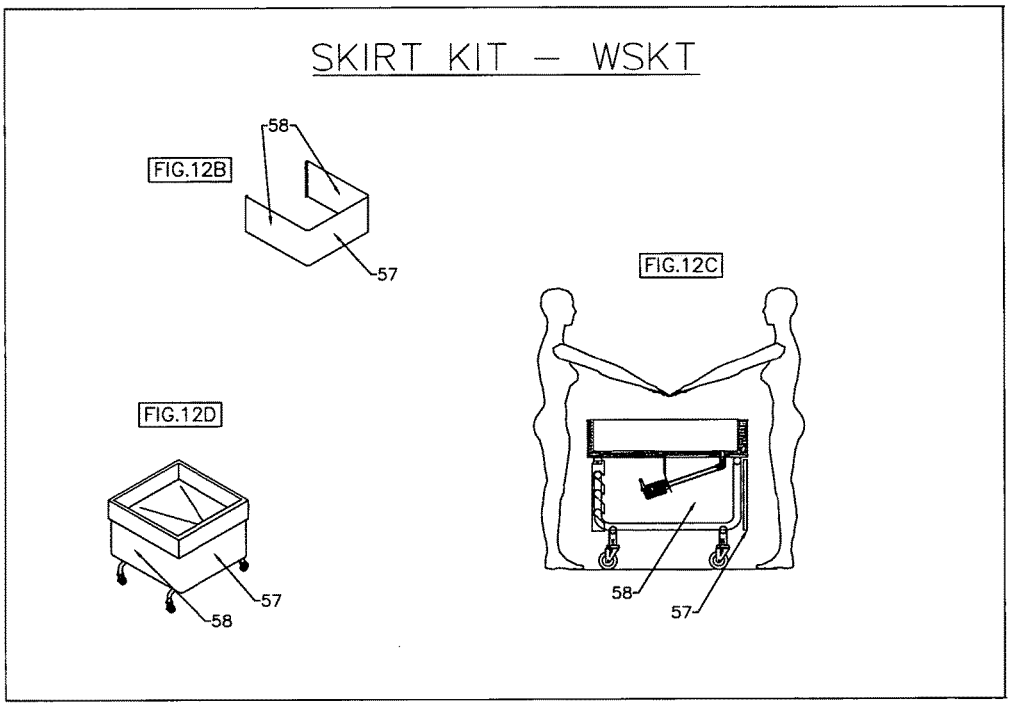
FIG. 12C-12D are Cross Section and Isometric Views of the Skirt Kit ("WSKT") installed on the Mobile Insulated Display Table.
Figure 12E:
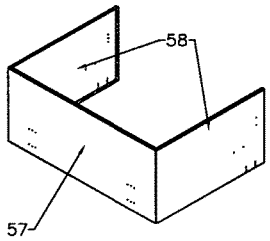
FIG. 12E-12G are Isometric, Plan and Cross Section Views of the Skirt Kit ("WSKT") without mounting clips.
Figure 12F:
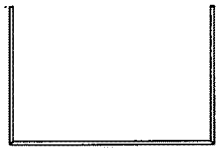
Figure 12G:
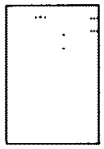
Figure 12H:
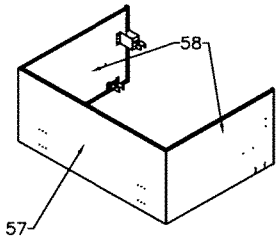
FIG. 12H-12J are Isometric, Plan and Cross Section Views of the Skirt Kit ("WSKT") with mounting clips.
Figure 12I:
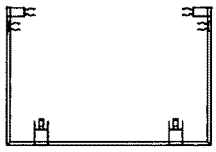
Figure 12J:
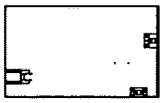
Figures 12K, 12L, 12M, 12N, 12O:
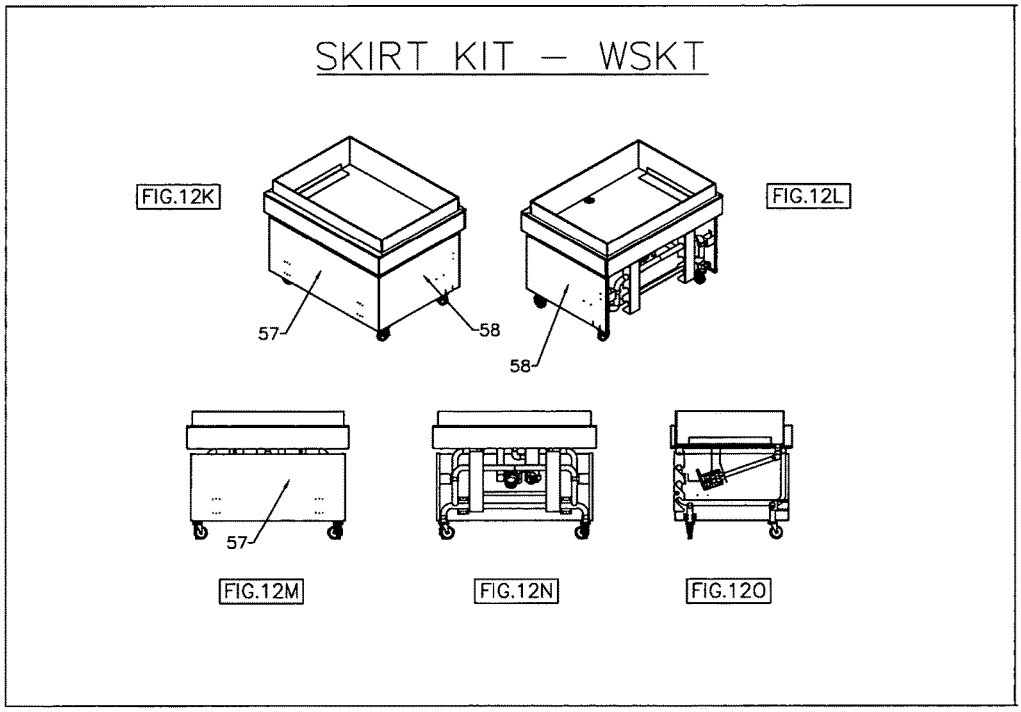
FIG. 12K-12O are Front, Back, Isometric and Cross Section Views of the Skirt Kit ("WSKT") installed on the Mobile Insulated Display Table.
Figures 13A, 13B, 13C, 13D, 13E, 13F:
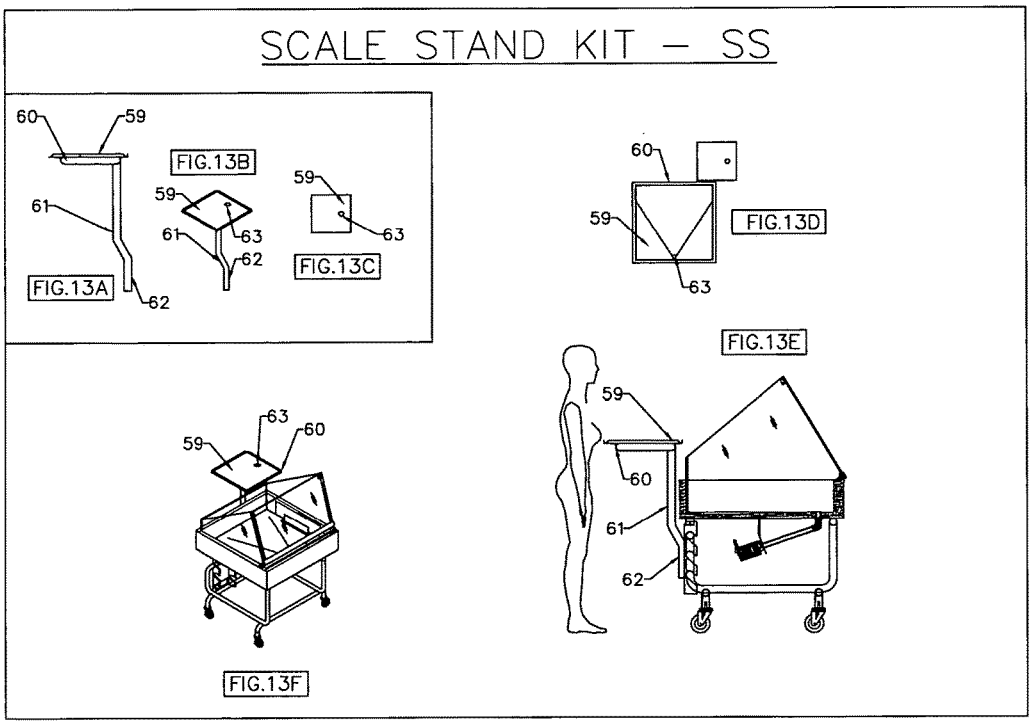
FIG. 13A-13C are Isometric, Plan, and Cross Section Views of the Scale Stand Kit ("SS") without mounting hardware.
FIG. 13D is a Plan View of the Scale Stand Kit ("SS") installed on the Mobile Insulated Display Table.
FIG. 13E-13F are Isometric and Cross Section Views of the Scale Stand Kit ("SS") installed on the Mobile Insulated Display Table along with the Full-Service Kit ("FSKT").
Figures 14A, 14B, 14C, 14D, 14E, 14F:
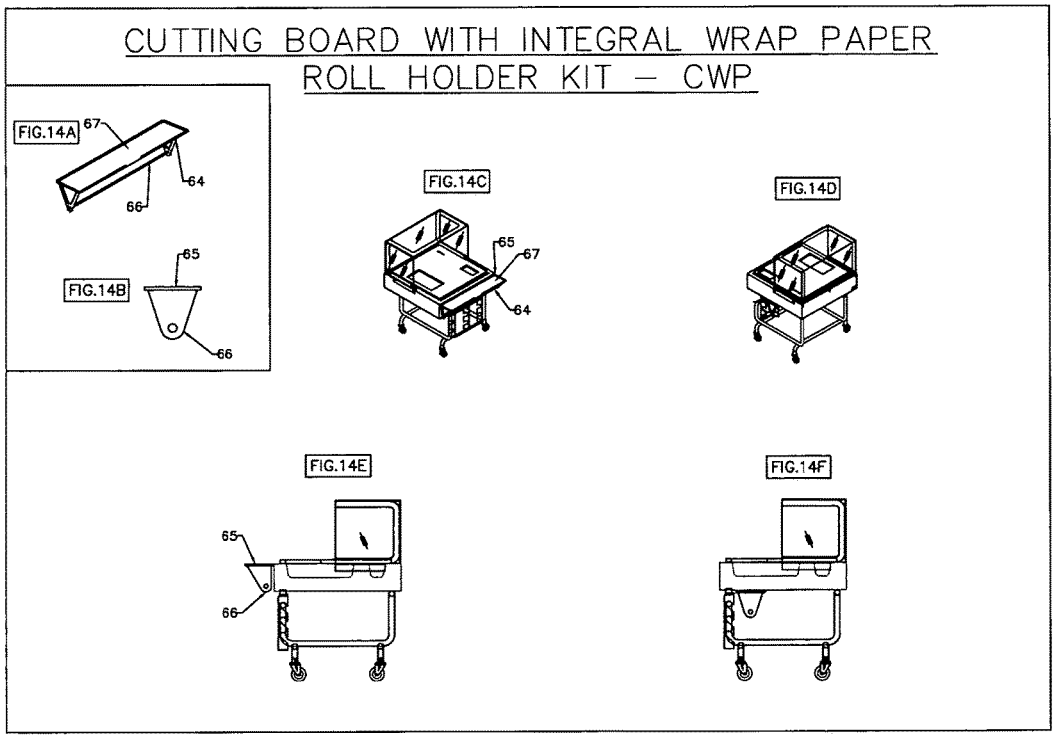
FIG. 14A-14B are Isometric and Side Views of the Cutting Board with Integral Wrap Paper Roll Holder Kit ("CWP") without its Polymer Cutting Board.
FIG. 14C-14F are Isometric and Cross Section Views of the Cutting Board with Integral Wrap Paper Roll Holder Kit ("CWP") installed on the rear and the underbody of the Mobile Insulated Display Table along with the Half-Canopy Kit ("HCKT") and the Meat Cutting Kit ("MCKT").
Figures 15A, 15B, 15C, 15D, 15E, 15F, 15G, 15H, 15I:
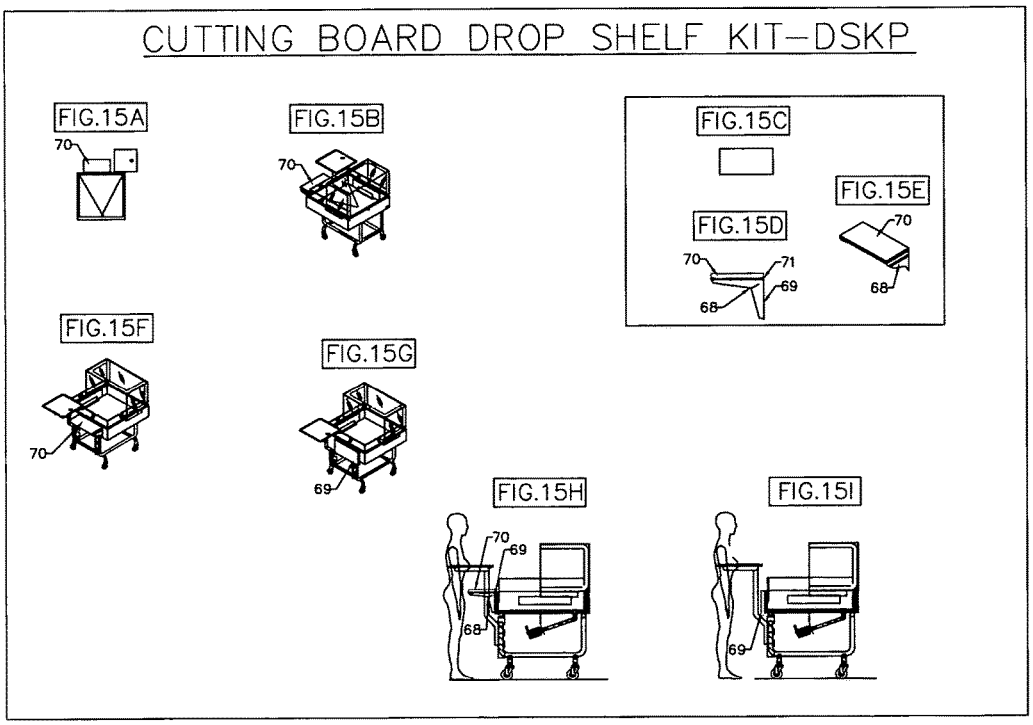
FIG. 15A shows a Plan View of the Cutting Board Drop Shelf Kit ("DSKP") installed on the Mobile Insulated Display Table.
FIG. 15B shows an Isometric View of the Cutting Board Drop Shelf Kit ("DSKP") installed on the Mobile Insulated Display Table in up position, along with the Scale Stand Kit (SS) and the Half-Canopy Kit ("HCKT").
FIG. 15C-15E are Isometric, Plan, and Cross Section Views of the Cutting Board Drop Shelf Kit ("DSKP") in up position.
FIG. 15F-15I are Isometric and Cross Section Views of the Cutting Board Drop Shelf Kit ("DSKP") installed on the Mobile Insulated Display Table in up and down position, along with the Scale Stand Kit (SS) and the Half-Canopy Kit ("HCKT").
Figure 16A:
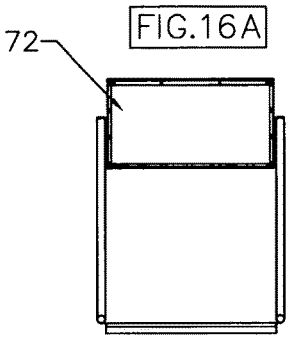
FIG. 16A is an Elevation View of the Chef Demo Mirror Kit ("CDMKT").
Figure 16B:
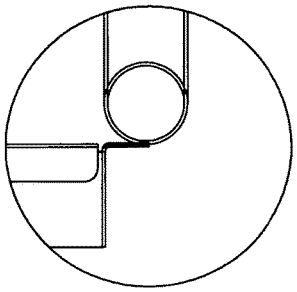
FIG. 16B is a Detail View of the Tubular Structure of the Chef Demo Mirror Kit ("CDMKT").
Figure 16C:
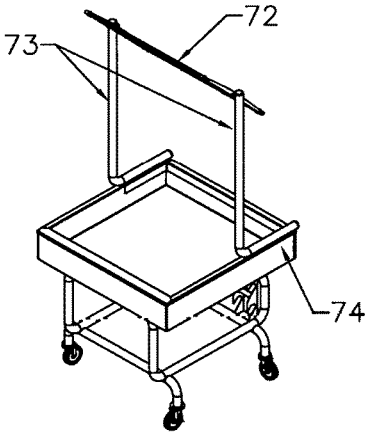
FIG. 16C is an Isometric View of the Chef Demo Mirror Kit ("CDMKT") installed on the Mobile Insulated Display Table.
Figure 16D:
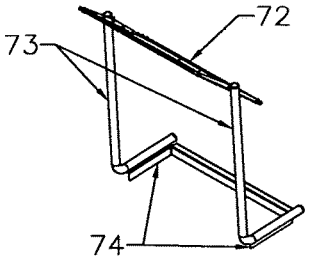
FIG. 16D-16E are Isometric and Cross Section Views of the Chef Demo Mirror Kit ("CDMKT").
Figure 16E:
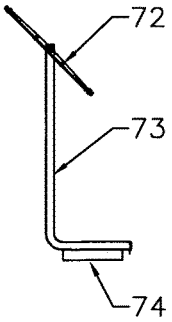

FIG. 12A-12O shows the Skirt Kit ("WSKT"). This removable kit is comprised of a permanently affixed removable stainless steel cosmetic base panel with a front 57 and two sides 58.

FIG. 13A-13F shows the Scale Stand Kit ("SS"). The scale stand kit is removable and is comprised of a 16 gauge 304 stainless steel scale platform 59 with safety retention sides 60, stainless steel support post 61, mounting hardware 62 and a scale cord chase 63.

FIG. 14A-14F shows the Cutting Board with Integral Wrap Paper Roll Holder ("CWP"). This removable kit is comprised of 3 components including: a cutting board platform 64 with mounting bracket 65 and integral wrap paper roll holder 66 and a poly cutting board 67. The assembly can be mounted on employee side of the MIT-M FIG. 1A-1Z and removed without tools or hardware.

FIG. 15A-15I shows the Cutting Board Drop Shelf Kit ("DSKP"). This removable kit is comprised of 2 components including: a cutting board platform 68 with drop hardware 69 and a poly cutting board 70, attached to a mounting bracket 71 which makes the kit easy to install and remove without tools or hardware.

FIG. 16A-16E shows the Chef Demo Mirror Kit ("CD-MKT"). This removable kit is comprised of 5 components including: an adjustable overhead mirror 72, and a tubular stainless steel support structure 73 with mounting brackets 74 on both sides.

Figures 17A, 17B, 17C, 17D, 17E, 17F, 17G, 17H, 17I, 17J, 17K, 17L, 17M, 17N, 17O:
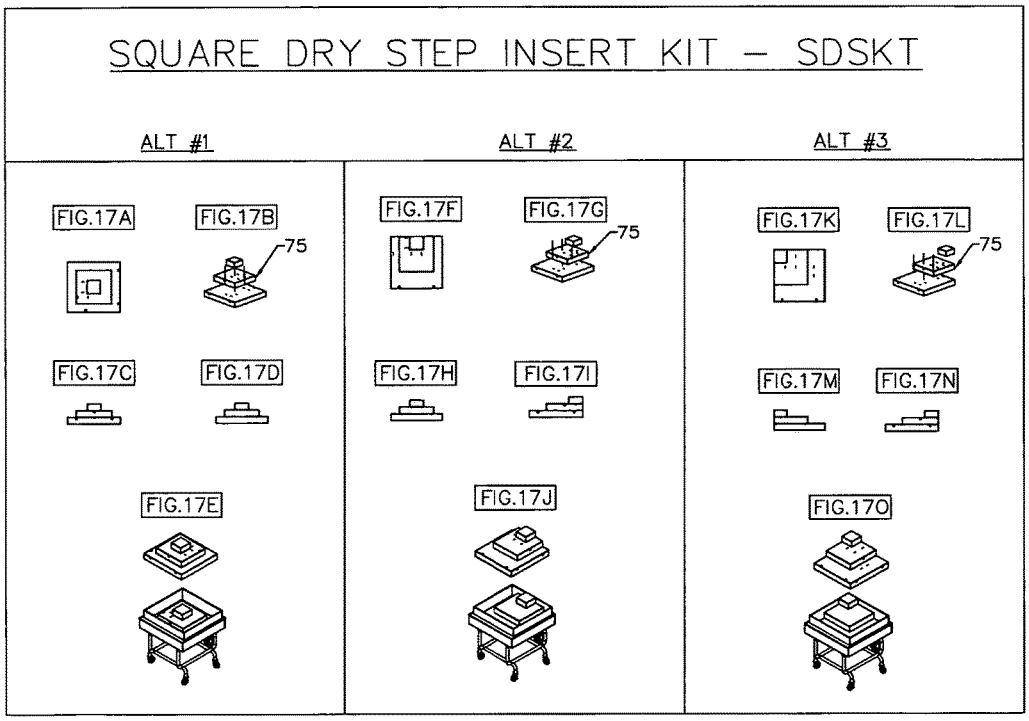
FIG. 17A-17D are Isometric, Front, Plan and Cross Section Views of the Square Dry Step Insert Kit ("SDSKT"), separated and assembled, in Alt #1 Position.
FIG. 17E is an Isometric View of the Square Dry Step Insert Kit ("SDSKT") in Alt #1 Position, going into place on the Mobile Insulated Display Table with the Self-Service Kit ("SSKT") already installed.
FIG. 17F-17I are Isometric, Front, Plan and Cross Section Views of the Square Dry Step Insert Kit ("SDSKT"), separated and assembled, in Alt #2 Position.
FIG. 17J is an Isometric View of the Square Dry Step Insert Kit ("SDSKT") in Alt #2 Position, going into place on the Mobile Insulated Display Table with the Self-Service Kit ("SSKT") already installed.
FIG. 17K-17N are Isometric, Front, Plan and Cross Section Views of the Square Dry Step Insert Kit ("SDSKT"), separated and assembled, in Alt #3 Position.
FIG. 17O is an Isometric View of the Square Dry Step Insert Kit ("SDSKT") in Alt #3 Position, going into place on the Mobile Insulated Display Table with the Self-Service Kit ("SSKT") already installed.

FIG. 17A-17O shows the Square Dry Step Insert Kit ("SDSKT"). This removable kit is comprised of 3 components including: 3 interlocking stainless steel platforms 75 that are tabbed and slotted so they can be configured in 9 different layouts.

Figures 18A, 18B, 18C, 18D, 18E, 18F, 18G, 18H, 18I, 18J, 18K, 18L, 18M, 18N, 18O, 18P, 18Q, 18R, 18S:
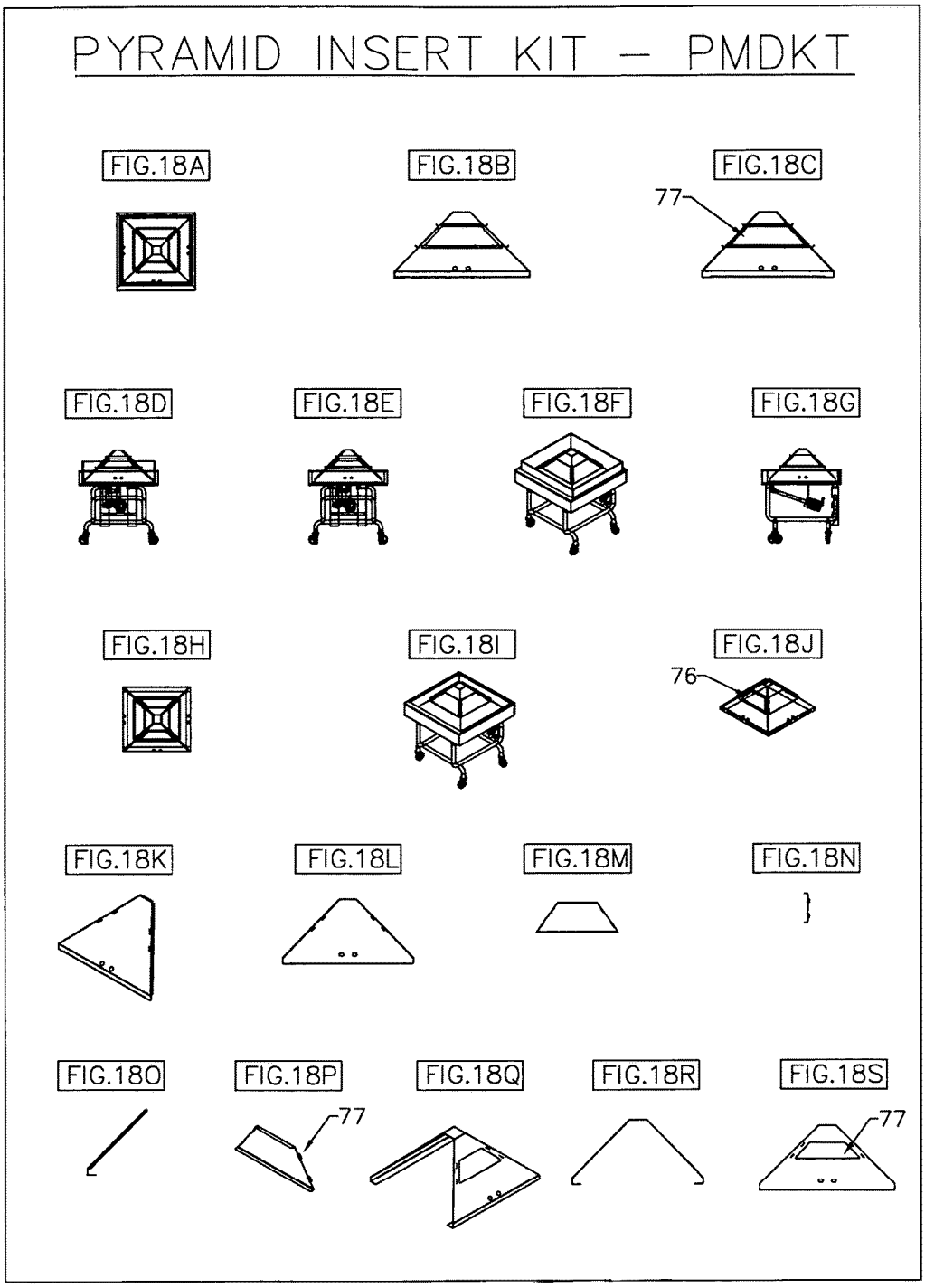
FIG. 18A is a Plan View of the Pyramid Insert Kit ("PMDKT") installed on the Mobile Insulated Display Table.
FIG. 18B-18C are Front Elevation and Cross Section Views of the Pyramid Insert Kit ("PMDKT") with its Removable Ice Stops in place.
FIG. 18D is a Cross Section View of the Pyramid Insert Kit ("PMDKT") installed on the Mobile Insulated Display Table, along with the Self-Service Kit ("SSKT").
FIG. 18E is a Cross Section View of the Pyramid Insert Kit ("PMDKT") installed on the Mobile Insulated Display Table with its Removable Ice Stops in place.
FIG. 18F is an Isometric View of the Pyramid Insert Kit ("PMDKT") installed on the Mobile Insulated Display Table with its Removable Ice Stops in place, along with the Self-Service Kit ("SSKT").
FIG. 18G is a Side View of the Pyramid Insert Kit ("PMDKT") installed on the Mobile Insulated Display Table.
FIG. 18H is a Plan View of the Pyramid Insert Kit ("PMDKT") with its Removable Ice Stops in place.
FIG. 18I is an Isometric View of the Pyramid Insert Kit ("PMDKT") installed on the Mobile Insulated Display Table with its Removable Ice Stops in place.
FIG. 18J is an Isometric View of the Pyramid Insert Kit ("PMDKT") with its Removable Ice Stops in place.
FIG. 18K-18L are Isometric and Plan Views of a Solid Side Panel of the Pyramid Insert Kit ("PMDKT") without its Removable Ice Stops in place.
FIG. 18M-18P are Isometric, Side, Plan, and Cross Section Views of a Removable Ice Stop which gets placed over a cutout on a Solid Side Panel of the Pyramid Insert Kit ("PMDKT").
FIG. 18Q is an Isometric View of the Pyramid Insert Kit ("PMDKT") without a Solid Side Panel and without its Removable Ice Stop in place on one side.
FIG. 18R is a Cross Section View of the Pyramid Insert Kit ("PMDKT") without a Removable Ice Stop in place.
FIG. 18S is a Side View of a Solid Side Panel of the Pyramid Insert Kit ("PMDKT") without a Removable Ice Stop in place.
Figures 19A, 19B, 19C, 19D, 19E, 19F, 19G, 19H, 19I, 19J, 19K, 19L, 19M:
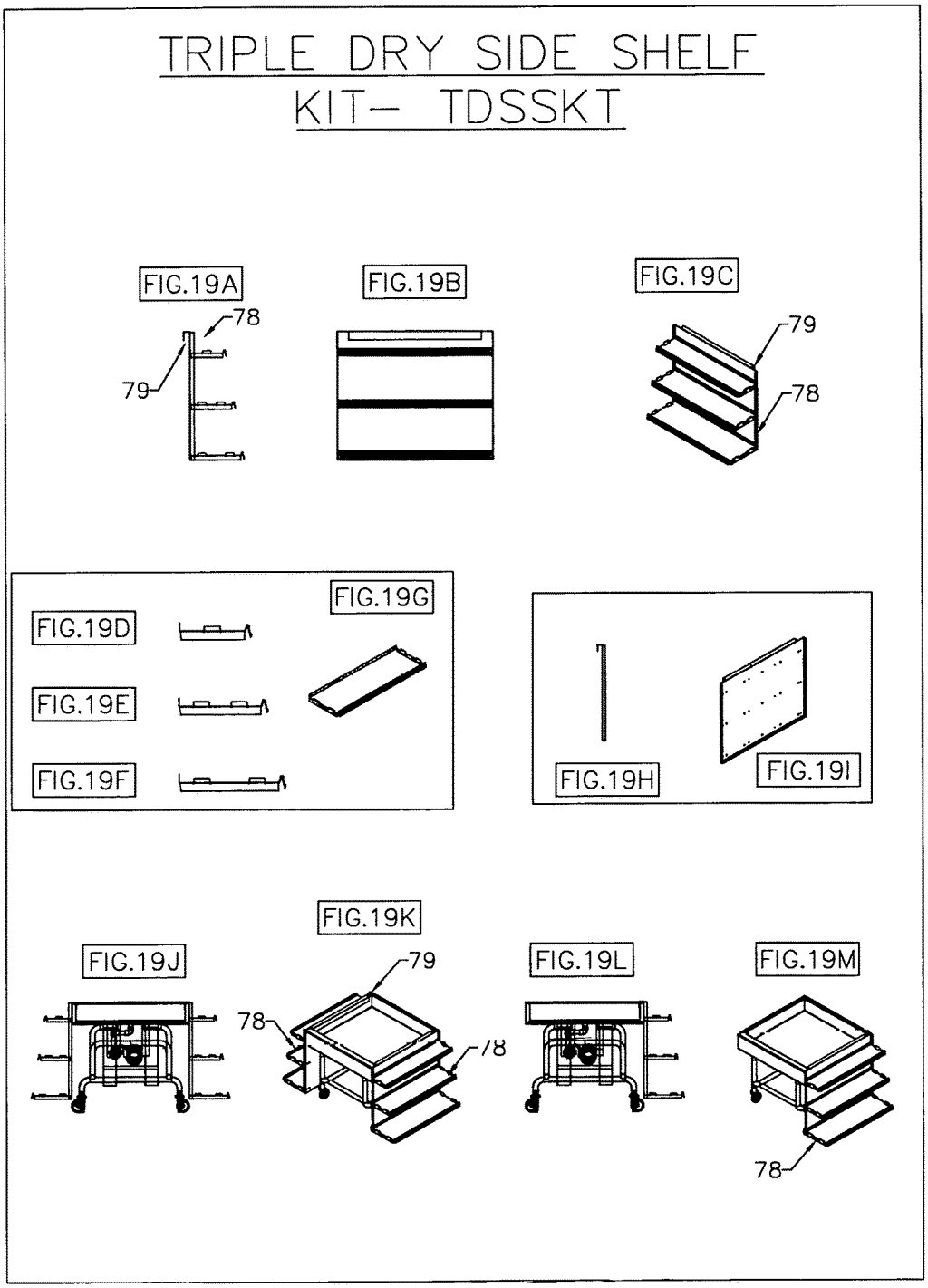
FIG. 19A-19C are Isometric, Side, and Cross Section Views of the Triple Dry Side Shelf Kit ("TDSSKT").
FIG. 19D-19G are Isometric and Cross Section Views of the Top, Middle, and Bottom Shelves of the Triple Dry Side Shelf Kit ("TDSSKT").
FIG. 19H-19I are Isometric and Side Views of the Shelf Hanger Piece of the Triple Dry Side Shelf Kit ("TDSSKT").
FIG. 19J-19M are Isometric and Cross Section Views of the Triple Dry Side Shelf Kit ("TDSSKT") installed on one and both sides of the Mobile Insulated Display Table.

FIG. 18A-18S shows the Pyramid Insert Kit ("PMDKT"). This removable kit is comprised of 5 components including: fully welded stainless steel pyramid featuring a 4" flat square top 76 with slots and cutouts to fit 4 removable side panels/ice avalanche guards which have tabs on their ends for insertion 77.

FIG. 19A-19M shows the Triple Dry Side Shelf Kit ("TDSSKT"). This removable kit is comprised of 1 component: heavy gauge fully welded three level stainless steel dry display shelf assembly 78, designed with mounting bracket 79 which allows installation and removal of the kit without tools or hardware on any of 3 sides of MIT-M FIG. 1A-1Z.

Figures 20A, 20B, 20C, 20D, 20E, 20F, 20G, 20H, 20I, 20J, 20K, 20L, 20M, 20N, 20O:
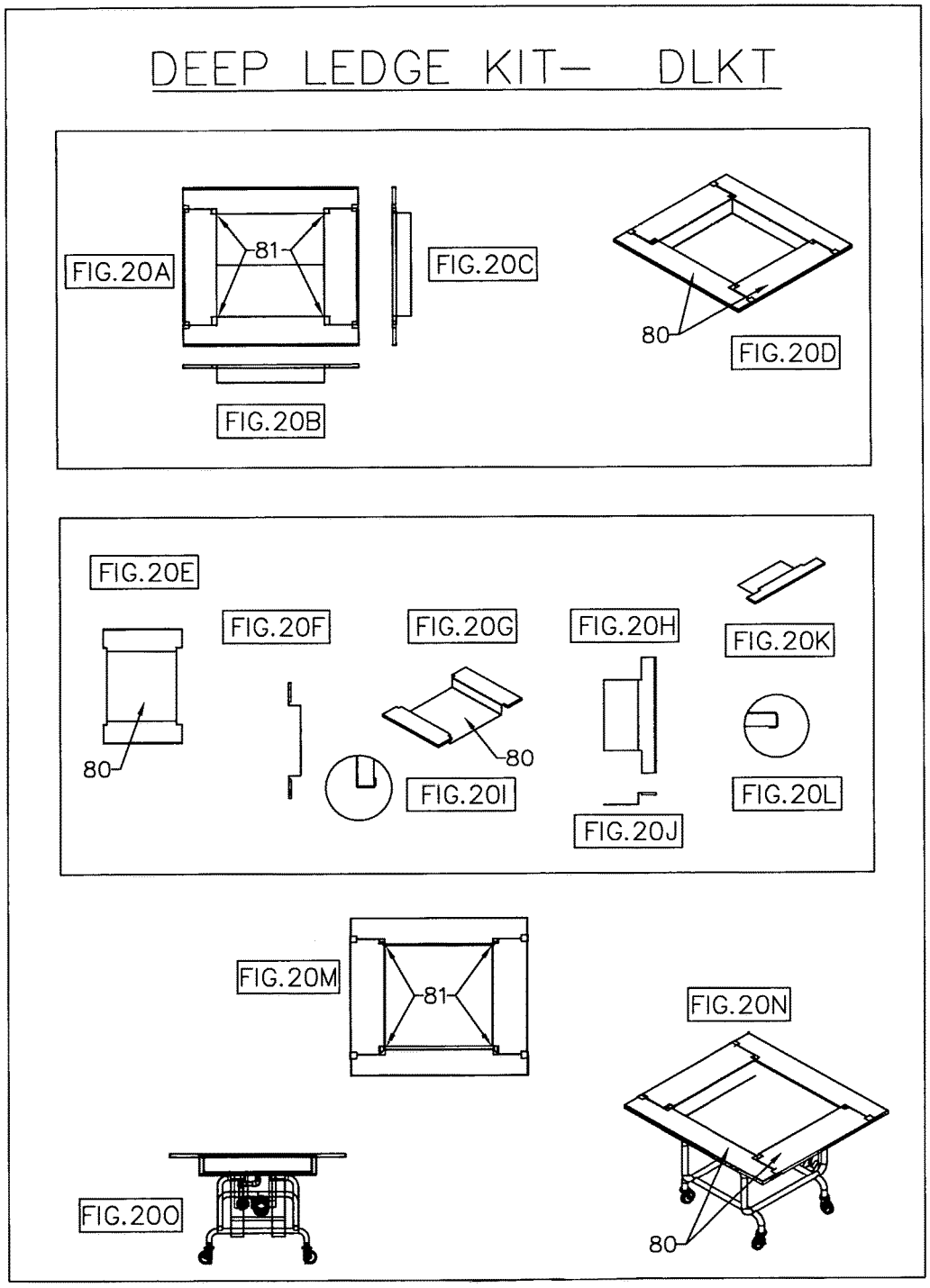
FIG. 20A-20D are Isometric, Plan, Front, and Cross Section Views of the Deep Ledge Kit ("DLKT").
FIG. 20E-20H are Isometric, Plan, and Side Views of the shallow and deep sections of the Deep Ledge Kit ("DLKT").
FIG. 20I is a Detailed View of the edge of the Deep Ledge Kit ("DLKT").
FIG. 20J-20K are Isometric, Plan, and Side Views of the shallow and deep sections of the Deep Ledge Kit ("DLKT").
FIG. 20L is a Detailed View of the edge of the Deep Ledge Kit ("DLKT").
FIG. 20M-20O are Isometric, Plan, and Cross Section Views of the Deep Ledge Kit ("DLKT") installed on the Mobile Insulated Display Table.
Figures 21A, 21B, 21C, 21D, 21E, 21F, 21G, 21H, 21I, 21J:
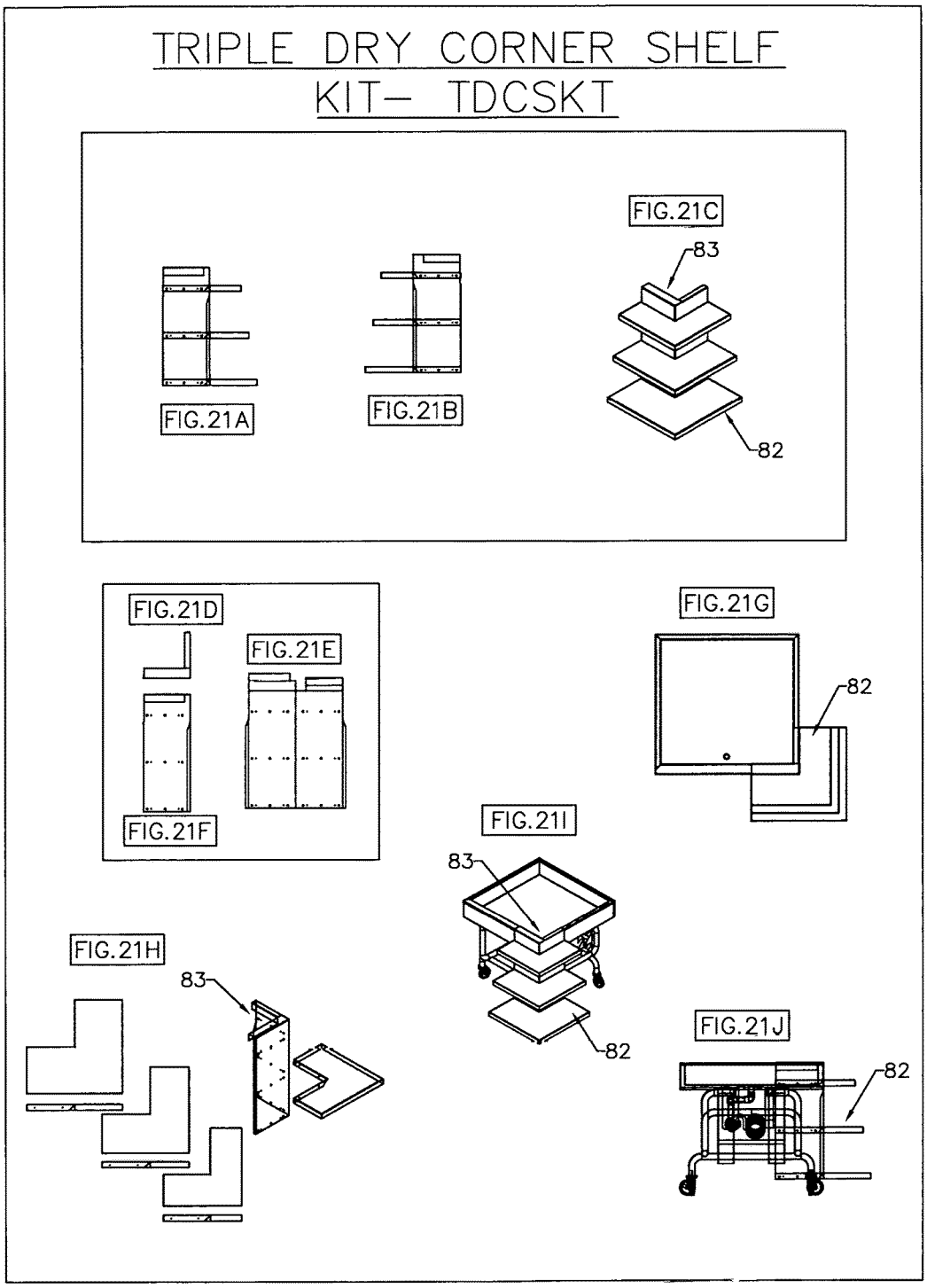
FIG. 21A-21C are Isometric and Cross Section Views of the Triple Dry Corner Shelf Kit ("TDCSKT").
FIG. 21D is a Plan View of the Rear Wall Panel of the Triple Dry Corner Shelf Kit ("TDCSKT").
FIG. 21E-21F are Front Elevation and Cross Section Views of the Rear Wall Panel of the Triple Dry Corner Shelf Kit ("TDCSKT") prior to having shelves installed.
FIG. 21G is a Plan View of the assembled Triple Dry Corner Shelf Kit ("TDCSKT") installed on the Mobile Insulated Display Table.
FIG. 21H is an Isometric and Exploded Plan View of the Triple Dry Corner Shelf Kit ("TDCSKT").
FIG. 21I-21J are Isometric and Cross Section Views of the Triple Dry Corner Shelf Kit ("TDCSKT") installed on the Mobile Insulated Display Table.
Figures 22A, 22B, 22C, 22D, 22E, 22F, 22G:
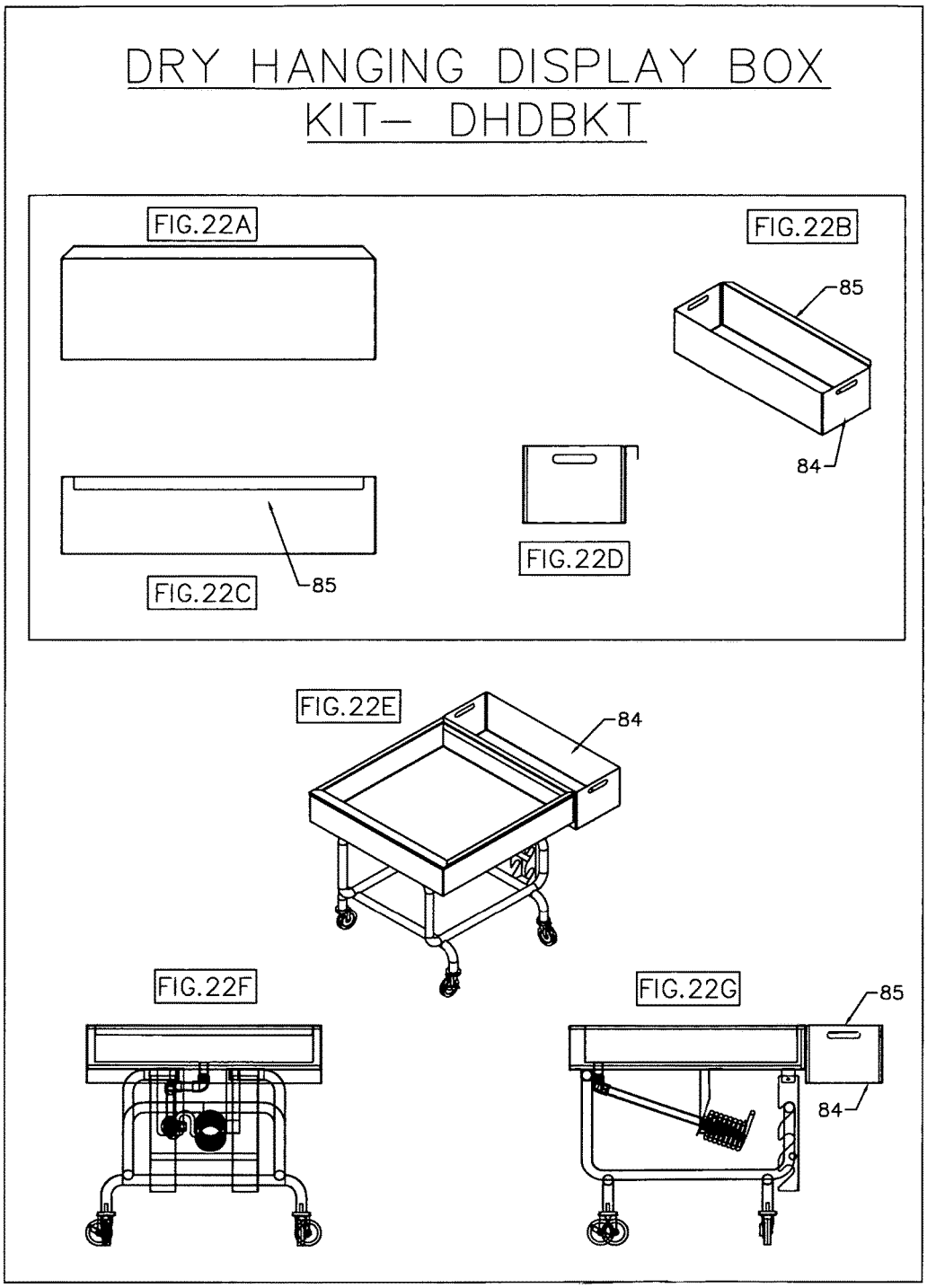
FIG. 22A-22D are Isometric, Plan, Side, and Rear Views of the Dry Hanging Display Box Kit ("DHDBKT").
FIG. 22E-22G are Isometric, Side, and Cross Section Views of the Dry Hanging Display Box Kit ("DHDBKT") installed on the Mobile Insulated Display Table.
Figures 23A, 23B, 23C, 23D, 23E, 23F, 23G, 23H, 23I:
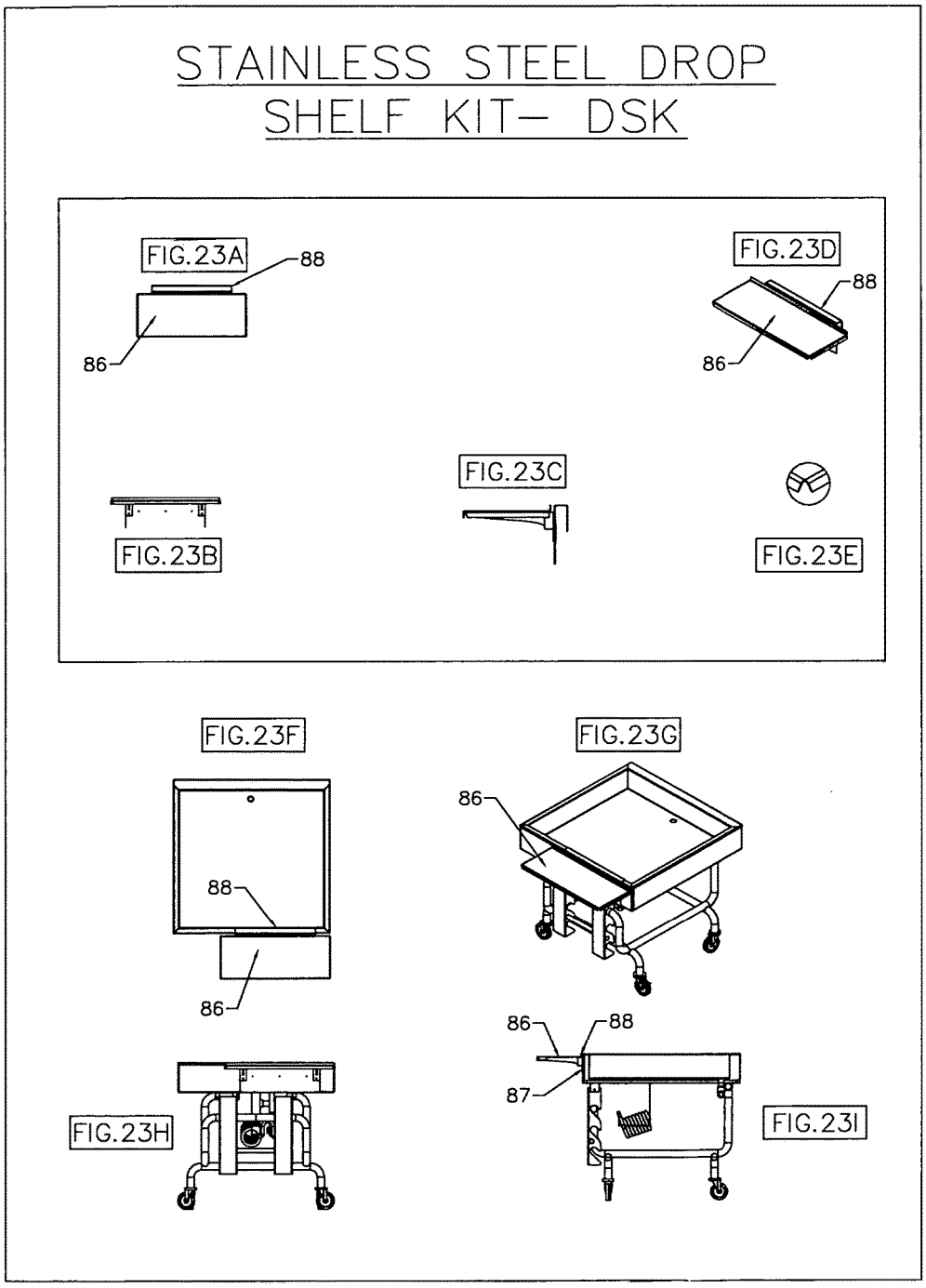
FIG. 23A-23D are Isometric, Plan, Front Elevation, and Cross Section Views of the Stainless Steel Drop Shelf Kit ("DSK") in up and down position.
FIG. 23E is a Detailed View of the corner of the Stainless Steel Drop Shelf Kit ("DSK").
FIG. 23F-23I are Isometric, Plan, Side, and Cross Section Views of the Stainless Steel Drop Shelf Kit ("DSK") installed on the Mobile Insulated Display Table in up position.
Figures 24A, 24B, 24C, 24D, 24E, 24F, 24G, 24H, 24I:
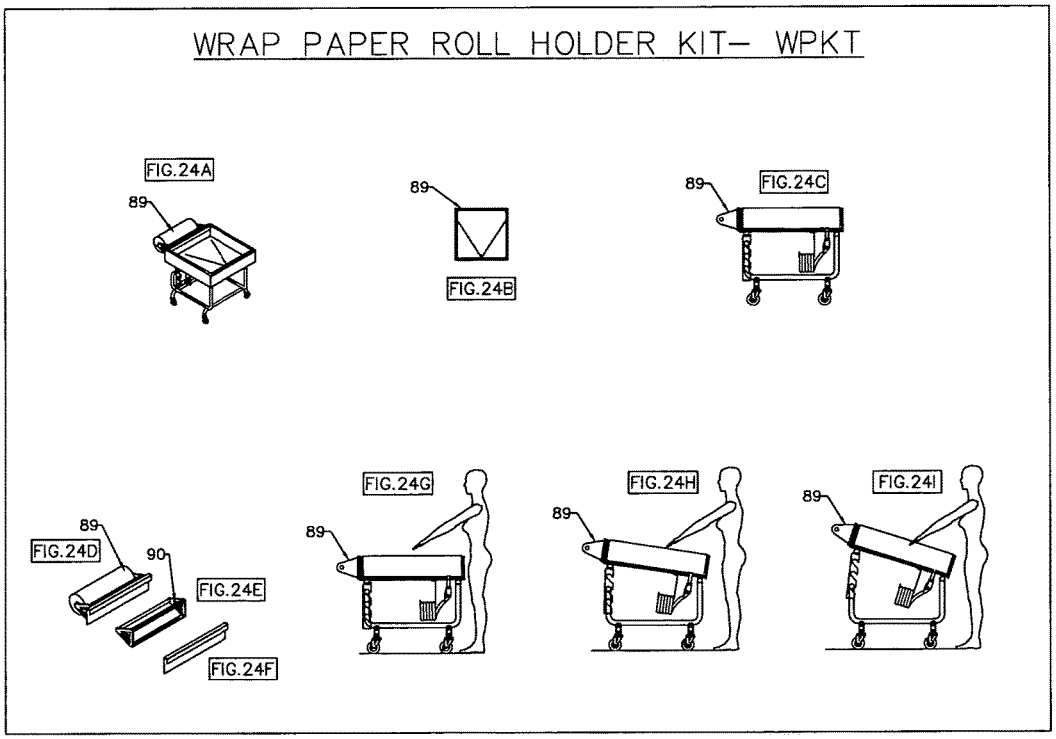
FIG. 24A-24C are Isometric, Plan, and Cross Section Views of the Wrap Paper Roll Holder Kit ("WPKT") installed on the Mobile Insulated Display Table in 0 degree pitch position.
FIG. 24D-24E are Isometric Views of the Wrap Paper Roll Holder Kit ("WPKT") with and without the mounting bracket and a roll of wrapping paper.
FIG. 24F is an Isometric View of the Mounting Bracket of the Wrap Paper Roll Holder Kit ("WPKT").
FIG. 24G-24I are Cross Section Views of the Wrap Paper Roll Holder Kit ("WPKT") installed on the Mobile Insulated Display Table in 0, 9, and 18 degree pitch position next to 64" tall customers.
Figure 25A:
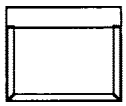
FIG. 25A-25E are Isometric, Plan, and Cross Section Views of the Trash Receptacle Kit ("TRKT") by itself and installed on the Mobile Insulated Display Table.
Figure 25B:
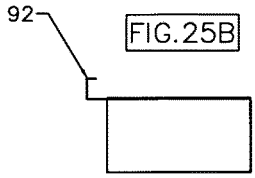
Figure 25C:
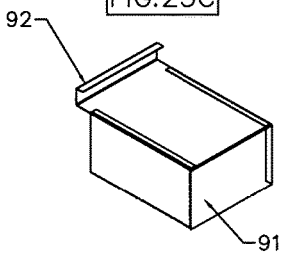
Figure 25D:
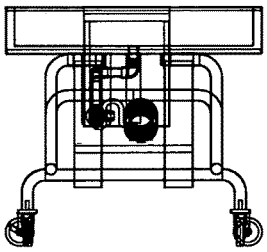
Figure 25E:
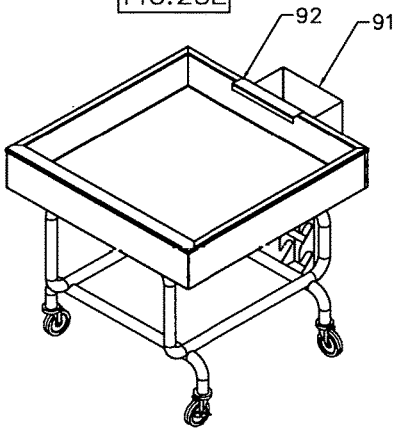
Figure 26A:
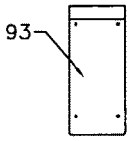
FIG. 26A is a Rear Elevation View of the Knife Holder Kit ("KHKT").
Figure 26C:
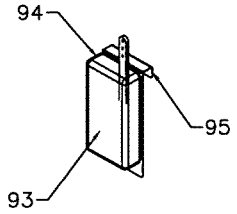
FIG. 26C-26D are Isometric Views of the Knife Holder Kit ("KHKT") by itself and installed on the Mobile Insulated Display Table with a knife in place.
Figure 26B:
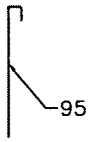
FIG. 26B is a Cross Section View of the Hanging Bracket of the Knife Holder Kit ("KHKT").
Figure 26D:
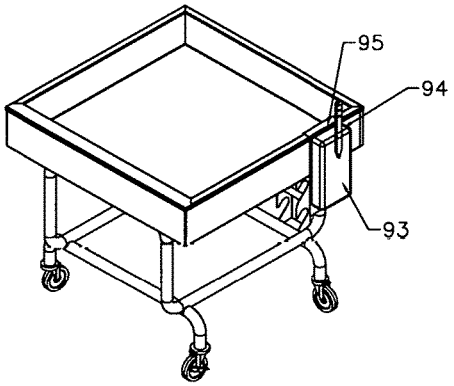
Figures 27A, 27B, 27C, 27D, 27E, 27F, 27G, 27H, 27I:
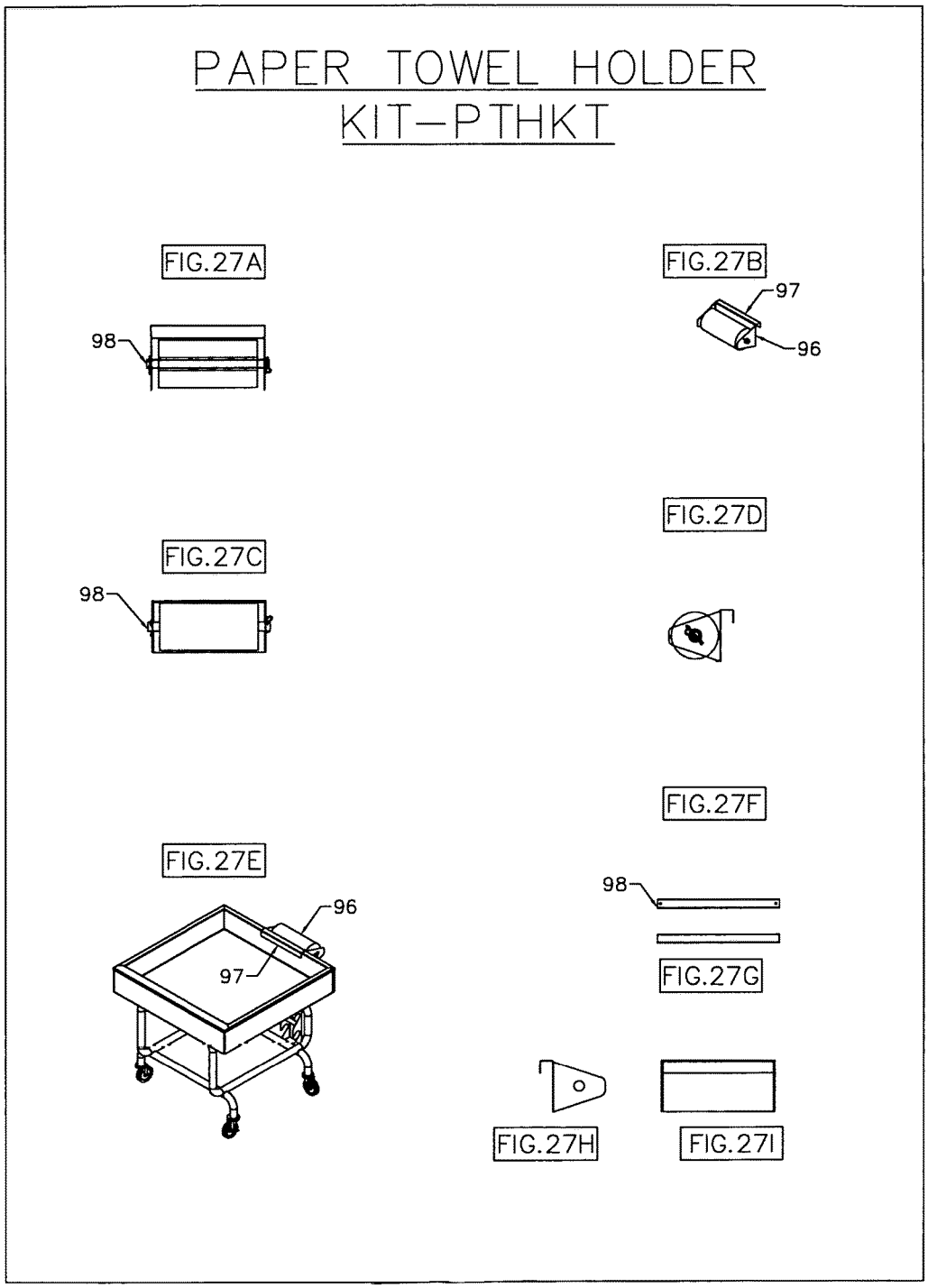
FIG. 27A-27D are Isometric, Rear, Plan, and Cross Section Views of the Paper Towel Holder Kit ("PTHKT") with a paper towel roll in place.
FIG. 27E is an Isometric View of the Paper Towel Holder Kit ("PTHKT") installed on the Mobile Insulated Display Table with a paper towel roll in place.
Figures 28A, 28B, 28C, 28D, 28E, 28F, 28G:
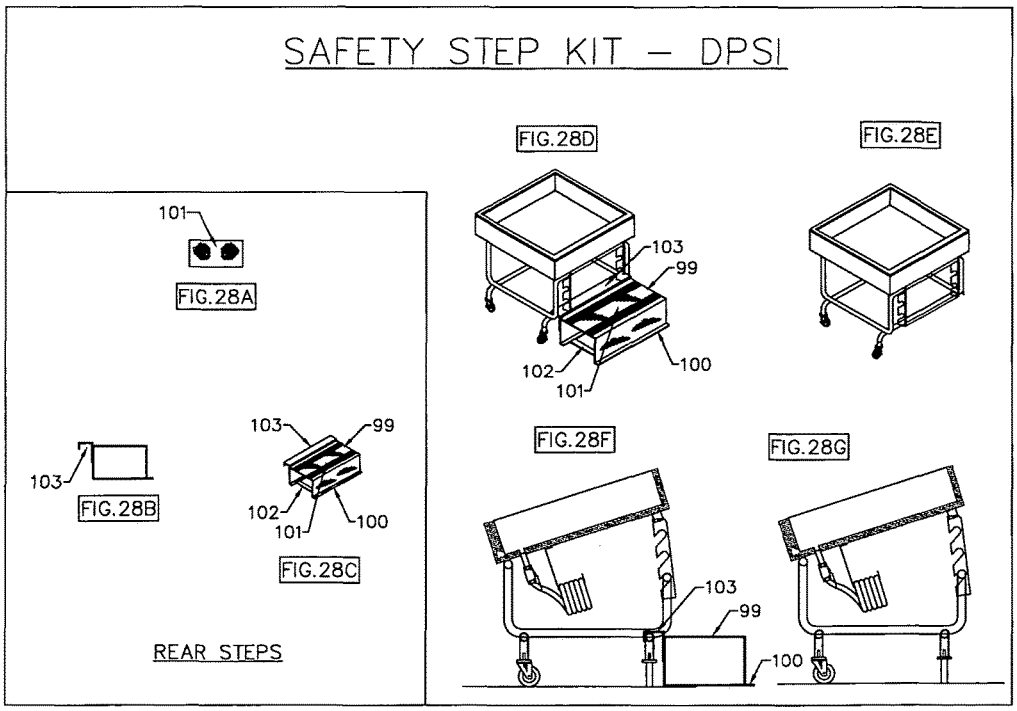

FIG. 20A-20N shows the Deep Ledge Kit ("DLKT"). This removable kit is comprised of 6 components: 2 each heavy gauge stainless steel extension shelf inserts 80 and 4 each locking brackets 81. Designed to be installed and removed without tools or hardware.

FIG. 21A-21J shows the Triple Dry Corner Shelf Kit ("TDCSKT"). This removable kit is comprised of 1 component: heavy gauge fully welded three level stainless steel dry corner display shelf assembly 82, designed with mounting bracket 83 which allows installation and removal of the kit without tools or hardware on 2 front corners of MIT-M FIG. 1A-1Z.

FIG. 22A-22G shows the Dry Hanging Display Box Kit ("DHDBKT"). This removable kit is comprised of 1 component: a heavy gauge welded stainless steel dry display box 84 with mounting bracket 85 that allows kit to be installed and removed without tools or hardware on any of 3 sides of MIT-M FIG. 1A-1Z.

FIG. 23A-23I shows the Stainless Steel Drop Shelf Kit ("DSK"). This removable kit is comprised of 1 assembly including a stainless steel shelf 86 with drop hinge hardware 87, and a stainless steel mounting bracket 88 that permits installation and removal on any of 3 sides of MIT-M FIG. 1A-1Z without tools or hardware.

FIG. 24A-24I shows the Wrap Paper Roll Holder Kit ("WPKT"). This accessory kit is comprised of 1 assembly including: a stainless steel paper wrap holder 89 with integrated cutting blade 90. Mounts to underside of MIT-M FIG. 1A-1Z.

FIG. 25A-25E shows the Trash Receptacle Kit ("TRKT"). This removable accessory kit is comprised of 1 component: a welded stainless steel trash receptacle 91 with integral hanging bracket 92 permitting kit to be installed and removed from any of 3 sides of MIT-M FIG. 1A-1Z without tools or hardware.

FIG. 26A-26D shows the Knife Holder Kit ("KHKT"). This removable accessory kit is comprised of 1 component: a stainless steel knife box 93 with slotted poly insert 94 to protect knife blades, with integral hanging bracket 95 permitting the kit to be installed and removed on any of 3 sides of MIT-M FIG. 1A-1Z.

FIG. 27A-27I shows the Paper Towel Holder Kit ("PTHKT"). This removable accessory kit is comprised of 2 components: a stainless steel paper towel holder 96 with bracket 97 to allow mounting and removal on any of 3 sides of MIT-M FIG. 1A-1Z without tools or hardware, plus a dowel 98 which passes through the paper towel roll.

FIG. 28A-28G shows the Safety Step Kit ("DPSI"). This removable accessory kit is comprised of 5 components: a diamond-plated aluminum safety step 99 with anti-tip base 100, anti-slip friction coating 101, two welded cross members 102 to support 500 pounds, and interlocking bracket 103 to allow mounting and removal on the bent tubular steel frame of MIT-M FIG. 1A-1Z without tools or hardware.

Although illustrative embodiments of the present invention have been described herein with reference to the accompanying drawings, it is to be understood that the invention is not limited to those precise embodiments and that various other changes and modifications may be effected herein by one skilled in the art without departing from the scope or spirit of the invention.

Furthermore, as various changes could be made in the described constructions, and additional accessory kits could be developed to integrate without departing from the scope of the invention, it is intended that all matter contained in these descriptions or shown in the accompanying drawings shall be interpreted as illustrative and not in a limiting sense.

What is claimed is:

1. A mobile table for use as a meat cutting station, the mobile table comprising:

a bent tubular steel frame supported by a plurality of casters;

one side of a support platform is pivotally connected to a first side of the bent tubular steel frame and at the opposite second side the support platform is connected to the bent tubular steel frame via a 3 position adjustable tilting mechanism;

wherein one of the positions causes the support platform to be in a substantial horizontal orientation;

the support platform has a flat planar base with upward extending sides that supports the edges of a removable poly chopping block so that the chopping block is spaced above the base of the support platform;

a drain is located in the flat planar base and combined with the upward extending sides creates a basin that is configured for fluid to drain from the basin through an insulated drain hose connected to the drain;

a plurality of knife retention safety slots each pass through the poly chopping block in one corner of the poly chopping block;

the knife retention safety slots are sized and configured to receive the blade of a chef knife;

a removable stainless steel drip pan with a poly liner is positioned on the support platform below the plurality of knife retention slots for collecting runoff through the plurality of knife retention safety slots;

the removable poly chopping block has a scrap chute opening that passes through the poly chopping block in an opposite corner;

a removable stainless steel scrap tray is positioned on the support platform below the scrap chute opening for collecting scrap through the scrap chute opening.

2. The mobile table of claim 1 further including a self-service kit, the self-service kit comprising:

four removable scratch resistant polymer panel risers with polished edges;

removable stainless steel retention clips which hold polymer panel risers in place while allowing removal without the use of tools.

3. The mobile table of claim 1 further including a half-canopy kit; the half-canopy kit comprising:

a removable welded stainless steel structural frame;

side polymer panel breath protection guards;

a front and a top made of clear polymer panel;

stainless steel mounting brackets.

* * * * *